US009195181B2

(12) United States Patent
Kamoda et al.

(10) Patent No.: US 9,195,181 B2
(45) Date of Patent: Nov. 24, 2015

(54) IMAGE FORMING APPARATUS AND IMAGE FORMING METHOD FOR FORMING AN IMAGE ON RECORDING MEDIA WITH DIFFERENT GLOSS LEVELS

(71) Applicant: Konica Minolta, Inc., Chiyoda-ku (JP)

(72) Inventors: Yuji Kamoda, Ibaraki (JP); Junya Hirayama, Takarazuka (JP); Shigeo Uetake, Takatsuki (JP); Toshiya Natsuhara, Takarazuka (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/156,942

(22) Filed: Jan. 16, 2014

(65) Prior Publication Data

US 2014/0205308 A1 Jul. 24, 2014

(30) Foreign Application Priority Data

Jan. 21, 2013 (JP) ..... 2013-008376

(51) Int. Cl.
*G03G 15/20* (2006.01)

(52) U.S. Cl.
CPC ..... *G03G 15/2021* (2013.01); *G03G 15/205* (2013.01); *G03G 2215/00805* (2013.01)

(58) Field of Classification Search
CPC ..... G03G 15/2021; G03G 15/205; G03G 15/2032; G03G 15/6585; G03G 15/6852; G03G 2215/00805; G03G 2215/0081
USPC ..... 399/67, 69, 335, 258, 260, 324, 340, 399/237, 250, 251
See application file for complete search history.

(56) References Cited

U.S. PATENT DOCUMENTS

2006/0251451 A1 11/2006 Ishigami et al.
2012/0237264 A1 9/2012 Hirayama et al.

(Continued)

FOREIGN PATENT DOCUMENTS

JP 3-116175 A 5/1991
JP 2003-098864 A 4/2003
JP 2003-167459 A 6/2003
JP 2005-265933 A 9/2005
JP 2005265933 A2 * 9/2005 ..... G03F 15/20

(Continued)

OTHER PUBLICATIONS

Japanese Office Action dated Feb. 3, 2015 issued in corresponding Japanese Patent Appln. No. 2013-008376, with English translation (6 pages).

*Primary Examiner* — Benjamin Schmitt
*Assistant Examiner* — Matthew Miller
(74) *Attorney, Agent, or Firm* — Buchanan Ingersoll & Rooney PC

(57) ABSTRACT

An image forming apparatus includes a noncontact heating device, a pressurizing and heating mechanism, and a control unit. The control unit switches an operation of the pressurizing and heating mechanism based on gloss level information of a recording medium. According to the image forming apparatus, assuming that a temperature of the recording medium after noncontact heating is T1, a temperature of the recording medium after pressurizing and heating is T2 and a toner concentration after noncontact heating is Tc1 when the gloss level information shows high gloss, and assuming that a temperature of the recording medium after noncontact heating is T3 and a toner concentration after noncontact heating is Tc2 when the gloss level information shows low gloss, the conditions of T1<T2, T1<T3, and Tc1<Tc2 are satisfied.

5 Claims, 21 Drawing Sheets

(56) References Cited

U.S. PATENT DOCUMENTS

2012/0263482 A1* 10/2012 Shiozawa ..... 399/39
2014/0376967 A1* 12/2014 Komatsuzaki et al. ..... 399/237

FOREIGN PATENT DOCUMENTS

JP 2005-338807 A 12/2005
JP 2012-194339 A 10/2012

* cited by examiner

FIG.9

| | TONER | CARRIER SOLUTION | RECORDING MEDIUM TEMPERATURE [°C] AFTER FIXATION | FIXATION PRESSURE [KPa] | TONER CONCENTRATION Tc1 [WEIGHT%] BEFORE COMPLETION OF FIXATION | GLOSS LEVEL |
|---|---|---|---|---|---|---|
| CONDITION 1 | TONER A | IP2028 | 140 | 400 | 54 | 47 |
| CONDITION 2 | TONER A | IP2028 | 140 | 400 | 72 | 55 |
| CONDITION 3 | TONER A | IP2028 | 140 | 400 | 80 | 59 |
| CONDITION 4 | TONER A | IP2028 | 140 | 400 | 90 | 64 |
| CONDITION 5 | TONER A | IP2028 | 125 | 400 | 54 | 34 |
| CONDITION 6 | TONER A | IP2028 | 125 | 400 | 72 | 45 |
| CONDITION 7 | TONER A | IP2028 | 125 | 400 | 90 | 55 |
| CONDITION 8 | TONER A | IP2028 | 125 | 400 | 100 | 61 |

FIG.12

| | TONER | CARRIER SOLUTION | RECORDING MEDIUM TEMPERATURE [°C] AFTER FIXATION | FIXATION PRESSURE [KPa] | TONER CONCENTRATION Tc1 [WEIGHT%] BEFORE COMPLETION OF FIXATION | GLOSS LEVEL |
|---|---|---|---|---|---|---|
| CONDITION 9 | TONER A | IP2028 | 140 | 500 | 54 | 57 |
| CONDITION 10 | TONER A | IP2028 | 140 | 500 | 60 | 59 |
| CONDITION 11 | TONER A | IP2028 | 140 | 500 | 70 | 64 |
| CONDITION 12 | TONER A | IP2028 | 140 | 500 | 72 | 65 |
| CONDITION 13 | TONER A | IP2028 | 140 | 500 | 90 | 74 |
| CONDITION 14 | TONER A | IP2028 | 125 | 500 | 54 | 44 |
| CONDITION 15 | TONER A | IP2028 | 125 | 500 | 72 | 55 |
| CONDITION 16 | TONER A | IP2028 | 125 | 500 | 80 | 59 |
| CONDITION 17 | TONER A | IP2028 | 125 | 500 | 90 | 65 |

FIG.16

| | TONER | CARRIER SOLUTION | RECORDING MEDIUM TEMPERATURE [°C] AFTER FIXATION | FIXATION PRESSURE [KPa] | TONER CONCENTRATION Tc1 [WEIGHT%] BEFORE COMPLETION OF FIXATION | GLOSS LEVEL |
|---|---|---|---|---|---|---|
| CONDITION 18 | TONER A | Isopar-L | 140 | 400 | 54 | 55 |
| CONDITION 19 | TONER A | Isopar-L | 140 | 400 | 60 | 58 |
| CONDITION 20 | TONER A | Isopar-L | 140 | 400 | 70 | 62 |
| CONDITION 21 | TONER A | Isopar-L | 140 | 400 | 72 | 63 |
| CONDITION 22 | TONER A | Isopar-L | 140 | 400 | 90 | 72 |
| CONDITION 23 | TONER A | Isopar-L | 125 | 400 | 54 | 43 |
| CONDITION 24 | TONER A | Isopar-L | 125 | 400 | 72 | 54 |
| CONDITION 25 | TONER A | Isopar-L | 125 | 400 | 80 | 57 |
| CONDITION 26 | TONER A | Isopar-L | 125 | 400 | 90 | 63 |

FIG.20

| | TONER | CARRIER SOLUTION | RECORDING MEDIUM TEMPERATURE [°C] AFTER FIXATION | FIXATION PRESSURE [KPa] | TONER CONCENTRATION Tc1 [WEIGHT%] BEFORE COMPLETION OF FIXATION | GLOSS LEVEL |
|---|---|---|---|---|---|---|
| CONDITION 27 | TONER B | IP2028 | 140 | 400 | 54 | 55 |
| CONDITION 28 | TONER B | IP2028 | 140 | 400 | 60 | 58 |
| CONDITION 29 | TONER B | IP2028 | 140 | 400 | 70 | 62 |
| CONDITION 30 | TONER B | IP2028 | 140 | 400 | 72 | 63 |
| CONDITION 31 | TONER B | IP2028 | 140 | 400 | 90 | 72 |
| CONDITION 32 | TONER B | IP2028 | 125 | 400 | 54 | 42 |
| CONDITION 33 | TONER B | IP2028 | 125 | 400 | 72 | 53 |
| CONDITION 34 | TONER B | IP2028 | 125 | 400 | 80 | 57 |
| CONDITION 35 | TONER B | IP2028 | 125 | 400 | 90 | 64 |

FIG.24

| | TONER | CARRIER SOLUTION | RECORDING MEDIUM TEMPERATURE [°C] AFTER FIXATION | FIXATION PRESSURE [KPa] | TONER CONCENTRATION Tc1 [WEIGHT%] BEFORE COMPLETION OF FIXATION | GLOSS LEVEL |
|---|---|---|---|---|---|---|
| CONDITION 36 | TONER C | IP2028 | 140 | 500 | 54 | 46 |
| CONDITION 37 | TONER C | IP2028 | 140 | 500 | 72 | 55 |
| CONDITION 38 | TONER C | IP2028 | 140 | 500 | 80 | 59 |
| CONDITION 39 | TONER C | IP2028 | 140 | 500 | 90 | 65 |
| CONDITION 40 | TONER C | IP2028 | 125 | 500 | 54 | 33 |
| CONDITION 41 | TONER C | IP2028 | 125 | 500 | 72 | 44 |
| CONDITION 42 | TONER C | IP2028 | 125 | 500 | 90 | 54 |
| CONDITION 43 | TONER C | IP2028 | 125 | 500 | 100 | 60 |

IMAGE FORMING APPARATUS AND IMAGE FORMING METHOD FOR FORMING AN IMAGE ON RECORDING MEDIA WITH DIFFERENT GLOSS LEVELS

This application is based on Japanese Patent Application No. 2013-008376 filed with the Japan Patent Office on Jan. 21, 2013, the entire content of which is hereby incorporated by reference.

BACKGROUND OF THE INVENTION

1. Field of the Invention

The present invention relates to an image forming apparatus and an image forming method, and particularly to a wet-type image forming apparatus and an image forming method of forming an image on each of recording media with different gloss levels using a developer containing toner particles and a carrier solution while conveying the recording media.

2. Description of the Related Art

In the image forming apparatus employing a wet-type electrophotographic system, a toner image is formed using a developer containing toner particles and a carrier solution. In the presence of the carrier solution, the carrier solution inhibits aggregation of toner particles and smoothing of the surface. Accordingly, the carrier solution needs to be fully removed when a toner image is fixed on a recording medium.

As an image forming apparatus allowing improvement in the fixing performance of the toner image by adjusting the amount and the concentration of the carrier solution, Japanese Laid-Open Patent Publication No. 2005-265933 discloses an image forming apparatus including: a transfer device transferring a toner image onto a recording medium; and a fixing device fixing the transferred toner image and having a noncontact heating device heating the recording medium in a noncontact manner and a pressurizing and heating mechanism pressurizing and heating the recording medium.

SUMMARY OF THE INVENTION

Generally, there are a wide variety of types of recording media on which a toner image is formed, for example, including fine quality paper having a surface on which microscopic irregularities are formed, and coated paper having a surface covered by a coat layer and having a smooth surface shape. Due to their different surface shapes, fine quality paper and coated paper are greatly different in gloss level. Therefore, when an image is formed on each of recording media with different gloss levels using the same method, the difference between the gloss level (smoothness) of the recording medium itself and the gloss level of the image fixed on the recording medium may remarkably appear in the image quality. In this state, a viewer may feel strangeness from the formed image. For example, in the case where an image with a high gloss level is formed on a recording medium with a low gloss level, the image is viewed as if it is raised from the recording medium with a low gloss level. Therefore, it is desirable that the difference between the gloss level of the recording medium itself and the gloss level of the image fixed on the recording medium falls within an acceptable range.

In Japanese Laid-Open Patent Publication No. 2005-265933, however, it is not sufficiently taken into consideration that images are formed on recording media with different gloss levels. Thus, it is difficult to allow the difference between the gloss level of the recording medium itself and the gloss level of the image fixed on the recording medium to fall within the acceptable range.

The present invention has been made in light of the above-described problems. An object of the present invention is to provide an image forming apparatus and an image forming method, by which, in the case where an image is formed on each of a plurality of recording media with different gloss levels, the difference between the gloss level of the recording medium itself and the gloss level of the image fixed on the recording medium can be suppressed so as to fall within a desired acceptable range, thereby allowing improvement in image quality.

The image forming apparatus based on the present invention forms an image on a recording medium while conveying the recording medium. The image forming apparatus based on the present invention as described above includes a developing mechanism developing a toner image on an image carrier by a developer containing toner particles and a carrier solution; a transfer mechanism transferring the toner image developed on the image carrier onto the recording medium; a fixing unit having a noncontact heating device heating the toner image without contacting the toner image transferred onto the recording medium, and a pressurizing and heating mechanism disposed downstream of the noncontact heating device in a direction in which the recording medium is conveyed and capable of pressurizing and heating the toner image by causing the recording medium to pass through a nip portion formed by a heating member and a pressurizing member pressed in contact with each other; an obtaining unit obtaining gloss level information of the recording medium to be conveyed; and a control unit controlling an operation of each of the noncontact heating device and the pressurizing and heating mechanism. The control unit controls the operation of each of the noncontact heating device and the pressurizing and heating mechanism such that, when the gloss level information of the recording medium obtained in the obtaining unit shows high gloss, the recording medium is heated by the noncontact heating device and caused to pass through the nip portion so as to be pressurized and heated by the pressurizing and heating mechanism, and such that, when the gloss level information of the recording medium shows low gloss, the recording medium is heated by the noncontact heating device and caused to pass through the fixing unit without being pressurized and heated by the pressurizing and heating mechanism. Assuming that a temperature of the recording medium after being heated by the noncontact heating device is defined as T1 [° C.], a temperature of the recording medium after being pressurized and heated by the pressurizing and heating mechanism is defined as T2 [° C.], a toner concentration of the toner image after being heated by the noncontact heating device is defined as Tc1 [weight %] when the gloss level information of the recording medium shows high gloss, and assuming that a temperature of the recording medium after being heated by the noncontact heating device is defined as T3 [° C.] and a toner concentration of the toner image after being heated by the noncontact heating device is defined as Tc2 [weight %] when the gloss level information of the recording medium shows low gloss, the following equations (1), (2) and (3) are satisfied:

$$T1<T2 \quad \text{Equation (1);}$$

$$T1<T3 \quad \text{Equation (2);}$$

$$Tc1<Tc2 \quad \text{Equation (3).}$$

According to the image forming apparatus based on the present invention, it is preferable that, assuming that pressure applied when the toner image is pressurized by the pressurizing and heating mechanism is defined as P [KPa], a center value of a carbon number of molecules constituting the carrier solution is defined as C, a melting temperature of toner measured with a flow tester by using a ½ method is defined as Tm [° C.], and viscosity of the toner at the melting temperature is defined as η [Pa·s] when the gloss level information of the recording medium shows high gloss, the following equation (4) is satisfied:

$$Tc1 \geq -1.133 \times T2 + 239.667 + (-0.002 \times T2 + 0.08) \times (P - 400) + (0.05 \times T2 - 3) \times (C - 16) + (0.0055 \times T2 + 1.8083) \times (Tm - 143) + (0.0002 \times T2 - 0.01) \times (\eta - 200) \quad \text{Equation (4).}$$

According to the image forming apparatus based on the present invention, it is preferable that the pressurizing and heating mechanism has a pressing-contact/separation mechanism capable of switching between a pressed-contact state where the nip portion is formed by moving at least one of the heating member and the pressurizing member, and a separated state where the heating member and the pressurizing member are not in contact with each other. In this case, it is preferable that the control unit controls the operation of each of the noncontact heating device and the pressurizing and heating mechanism such that, when the gloss level information of the recording medium shows low gloss, the pressurizing and heating mechanism is set in the separated state by the pressing-contact/separation mechanism, and the recording medium is heated by the noncontact heating device and caused to pass through the pressurizing and heating mechanism in the separated state.

An image forming method of forming an image on a recording medium based on the present invention provides a method used in an image forming apparatus forming an image on a recording medium while conveying the recording medium. According to the image forming method of forming an image on a recording medium based on the present invention, the image forming apparatus includes a developing mechanism developing a toner image on an image carrier by a developer containing toner particles and a carrier solution; a transfer mechanism transferring the toner image developed on the image carrier onto the recording medium; and a fixing unit having a noncontact heating device heating the toner image without contacting the toner image transferred onto the recording medium, and a pressurizing and heating mechanism disposed downstream of the noncontact heating device in a direction in which the recording medium is conveyed and capable of pressurizing and heating the toner image by causing the recording medium to pass through a nip portion formed by a heating member and a pressurizing member pressed in contact with each other. The image forming method of forming an image on a recording medium based on the present invention performs the steps of obtaining gloss level information of the recording medium; developing the toner image on the image carrier by the developing mechanism; transferring the toner image developed on the image carrier onto the recording medium; and controlling an operation of each of the noncontact heating device and the pressurizing and heating mechanism such that, when the gloss level information obtained in the step of obtaining the gloss level information shows high gloss, the recording medium is heated by the noncontact heating device and caused to pass through the nip portion so as to be pressurized and heated by the pressurizing and heating mechanism, and such that, when the gloss level information obtained shows low gloss, the recording medium is heated by the noncontact heating device and caused to pass through the fixing unit without being pressurized and heated by the pressurizing and heating mechanism. Assuming that a temperature of the recording medium after being heated by the noncontact heating device is defined as T1 [° C.], a temperature of the recording medium after being pressurized and heated by the pressurizing and heating mechanism is defined as T2 [° C.], a toner concentration of the toner image after being heated by the noncontact heating device is defined as Tc1 [weight %] when the gloss level information of the recording medium shows high gloss, and assuming that a temperature of the recording medium after being heated by the noncontact heating device is defined as T3 [° C.] and a toner concentration of the toner image after being heated by the noncontact heating device is defined as Tc2 [weight %] when the gloss level information of the recording medium shows low gloss, the following equations (1), (2) and (3) are satisfied:

$$T1 < T2 \quad \text{Equation (1);}$$

$$T1 < T3 \quad \text{Equation (2);}$$

$$Tc1 < Tc2 \quad \text{Equation (3).}$$

According to the image forming method of forming an image on a recording medium based on the present invention, assuming that pressure applied when the toner image is pressurized by the pressurizing and heating mechanism is defined as P [KPa], a center value of a carbon number of molecules constituting the carrier solution is defined as C, a melting temperature of toner measured with a flow tester by using a ½ method is defined as Tm [° C.], and viscosity of the toner at the melting temperature is defined as η [Pa·s] when the gloss level information of the recording medium shows high gloss, the following equation (4) is satisfied:

$$Tc1 \geq -1.133 \times T2 + 239.667 + (-0.002 \times T2 + 0.08) \times (P - 400) + (0.05 \times T2 - 3) \times (C - 16) + (0.0055 \times T2 + 1.8083) \times (Tm - 143) + (0.0002 \times T2 - 0.01) \times (\eta - 200) \quad \text{Equation (4).}$$

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 9 is a diagram showing conditions and results of experiment 1.

FIG. 12 is a diagram showing conditions and results of experiment 2.

FIG. 16 is a diagram showing conditions and results of experiment 3.

FIG. 20 is a diagram showing conditions and results of experiment 4.

FIG. 24 is a diagram showing conditions and results of experiment 5.

DESCRIPTION OF THE PREFERRED EMBODIMENTS

Figure 1:
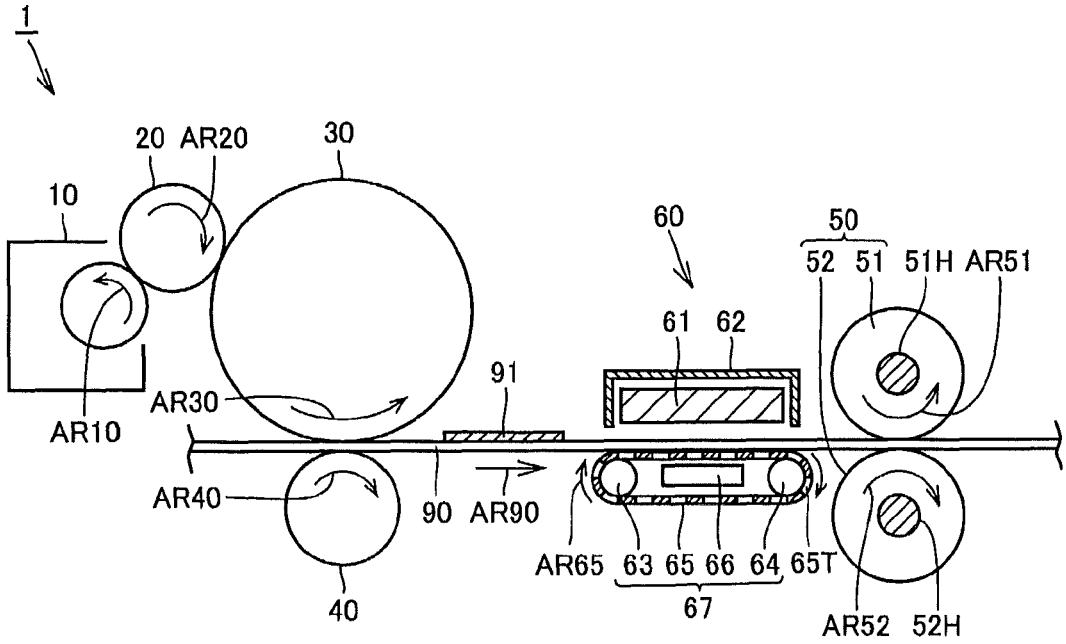
FIG. 1 is a schematic diagram of an image forming apparatus according to an embodiment of the present invention.

Embodiments of the present invention will be hereinafter described in detail with reference to the drawings. In the embodiments described below, the same or corresponding components are denoted by the same reference characters, and a description thereof will not be repeated.

The "gloss level" used in embodiments and experiments of the present invention is expressed by a value measured by a gloss meter "VG 2000" (manufactured by Nippon Denshoku Industries Co., Ltd) at an incident angle of 75° based on "JIS-Z8741-1983 Method 2".

Figure 2:
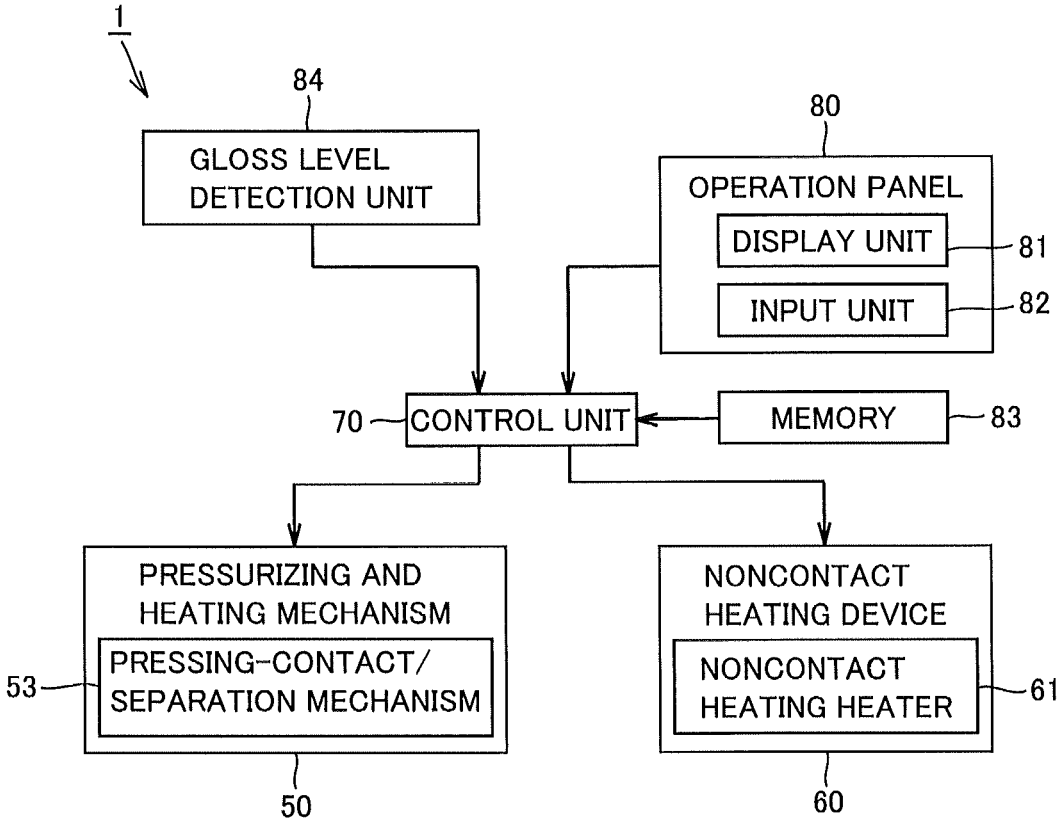
FIG. 2 is a block diagram showing the control configuration of the image forming apparatus shown in FIG. 1.

FIG. 1 is a schematic diagram of an image forming apparatus according to an embodiment of the present invention. FIG. 2 is a block diagram showing the control configuration of the image forming apparatus shown in FIG. 1. Referring to FIGS. 1 and 2, an image forming apparatus 1 and an image forming method according to the present embodiment will be hereinafter described.

As shown in FIG. 1, image forming apparatus 1 includes a developing device 10, an image carrier 20, an intermediate transfer body 30, a backup member 40, a pressurizing and heating mechanism 50 and a noncontact heating device 60 that serve as a fixing unit, and a control unit 70 (not shown in FIG. 1).

As shown in FIG. 2, image forming apparatus 1 further includes an operation panel 80, a memory 83 and a gloss level detection unit 84.

Operation panel 80 includes a display unit 81 notifying a user of various pieces of information, and an input unit 82 accepting various user operations. More specifically, operation panel 80 includes various input key groups including a ten key, a touch sensor and the like each functioning as an input unit, and also includes various indicators including a liquid crystal display unit integrated with the touch sensor, an LED (Light Emitting Diode) and the like each functioning as a display unit.

Memory 83 serves as a storage medium in which a program for performing various processes is stored in advance. Control unit 70 controls image forming apparatus 1 based on the information input from memory 83.

Gloss level detection unit 84 is provided on a conveyance path of image forming apparatus 1, and measures the gloss level of the recording medium that is being conveyed. Gloss level detection unit 84 includes a light emitting unit and a light receiving unit, and measures the gloss level of the surface of recording medium 90 on which the conveyed toner image is not formed. Control unit 70 stores the correspondence relation between the value measured by gloss level detection unit 84 and the value measured by a gloss meter "VG 2000" (manufactured by Nippon Denshoku Industries Co., Ltd) at an incident angle of 75° based on "JIS-Z8741-1983 Method 2". Control unit 70 can calculate the gloss level of recording medium 90 and compare this gloss level with a prescribed threshold value, thereby determining whether the recording medium is of high gloss or low gloss.

Control unit 70 controls the operations of pressurizing and heating mechanism 50 and noncontact heating device 60 based on the detection information input from gloss level detection unit 84. More specifically, control unit 70 controls the operations of a pressing-contact/separation mechanism 53 included in pressurizing and heating mechanism 50 and a noncontact heating heater 61 included in noncontact heating device 60.

Although a description has been made in the present embodiment by illustrating the case where gloss level detection unit 84 functions as a dedicated obtaining unit that detects the gloss level information, gloss level detection unit 84 is not an indispensable configuration, but operation panel 80 performing various operations of the image forming apparatus may function as an obtaining unit obtaining the gloss level information. In this case, by the configuration established such that the numerical value of the gloss level or the information about high gloss/low gloss is directly input when the user inputs the information about the type and the weight of recording medium 90 housed in a recording medium feeding unit through operation panel 80 of image forming apparatus 1, control unit 70 can obtain the gloss level information based on the input value. Furthermore, the information about the type of recording medium 90 is grouped in advance into a high gloss group or a low gloss group, for example, in such a manner that recording medium 90 of a "gloss paper" type or a "coated paper" type is grouped as a high gloss type, and recording medium 90 of a "plain paper" type or a "fine quality paper" type is grouped as a low gloss group, which is then stored in memory 83. By such a configuration, based on the information about the type of recording medium 90 that has been input, control unit 70 may determine whether the recording medium is of a high gloss type or a low gloss type.

As shown in FIG. 1, by using a liquid developer containing toner particles and a carrier solution, developing device 10 develops an electrostatic latent image formed when image carrier 20 uniformly charged by a charging device (not shown) is exposed by an exposure device (not shown). Consequently, a toner image corresponding to the shape of the electrostatic latent image is formed on the surface of image carrier 20. In this way, developing device 10 functions as a developing mechanism. In addition, developing device 10 applies a liquid developer to the surface of image carrier 20 while rotating in the direction indicated by an arrow AR10.

An insulating solvent can be employed as a carrier solution contained in the liquid developer. The toner particles used for a liquid developer are mainly composed of a resin material and pigments or colorants for coloring. The resin material has a function of uniformly distributing the pigments or colorants into the resin material, and a function as a binder at the time when a toner image is fixed on recording medium 90.

It is preferable that the volume average particle diameter of the toner particles in the liquid developer is 0.1 μm or greater and 5 μm or less. When the volume average particle diameter of the toner particles in the liquid developer is 0.1 μm or greater, these toner particles can readily allow development of an electrostatic latent image. Furthermore, when the volume average particle diameter of the toner particles in the liquid developer is 5 μm or less, the quality of the toner image is improved.

It is preferable that the proportion of the weight of the toner particles to the weight of the liquid developer (toner concentration) is 10% or higher and 50% or lower. When the proportion of the weight of the toner particles to the weight of the liquid developer is 10% or higher, sedimentation of the toner particles is less likely to occur. Thus, the toner particles exhibit relatively high stability over time during a long-term storage, and also, the amount of the liquid developer required for achieving a desired image density can be reduced. This can eliminate the need to dry a large amount of carrier solution when fixing a toner image, so that generation of a large amount of vapor from the carrier solution can be prevented. When the proportion of the weight of the toner particles to the weight of the liquid developer is 50% or lower, the viscosity of the liquid developer reaches an appropriate value, so that the liquid developer can be conveniently treated during production.

Image carrier 20 is cylindrically shaped and has a surface on which an image carrier layer (not shown) is formed. Image carrier 20 rotates in the direction indicated by an arrow AR20.

Intermediate transfer body 30 rotates in the direction indicated by an arrow AR30 while being in contact with image carrier 20. At a contact portion (nip portion) between image carrier 20 and intermediate transfer body 30, the toner image on the surface of image carrier 20 is transferred from image carrier 20 onto intermediate transfer body 30.

Backup member 40 is disposed so as to face intermediate transfer body 30, and rotates in the direction indicated by an AR40. Recording media 90 conveyed one by one from the recording medium feeding unit (not shown) pass through the contact portion (nip portion) between backup member 40 and intermediate transfer body 30, thereby transferring the toner image from intermediate transfer body 30 onto recording medium 90. Consequently, a toner image 91 is formed on the recording medium. In this way, intermediate transfer body 30 and backup member 40 correspond to a transfer mechanism for transferring a toner image formed on image carrier 20 onto recording medium 90. It is to be noted that recording medium 90 onto which toner image 91 is transferred is conveyed toward noncontact heating device 60 (see an arrow AR90).

Noncontact heating device 60 is disposed upstream of pressurizing and heating mechanism 50 in the direction in which recording medium 90 is conveyed (in the direction indicated by arrow AR90). Noncontact heating device 60 includes noncontact heating heater 61, a heat insulation cover 62, and a conveying unit 67. In the case where a recording medium with a low gloss level as described below is used, noncontact heating device 60 can fix the toner image transferred onto the recording medium with a low gloss level.

Noncontact heating heater 61 is disposed at the recording surface side of recording medium 90 (the surface onto which toner image 91 is transferred), and can heat recording medium 90 and toner image 91 transferred onto recording medium 90 without contacting these recording medium 90 and toner image 91. The toner concentration of toner image 91 before being heated by noncontact heating heater 61 is 30% or higher and 50% or lower due to the carrier solution being reduced by development and transfer when the toner concentration is relatively low. After transfer, the carrier solution evaporates by heating from noncontact heating heater 61 and the like, thereby increasing the toner concentration, and finally leading to a toner concentration close to 100%.

The temperature of the heating surface of noncontact heating heater 61 is set by control unit 70 at a desired temperature (for example, 200° C. to 700° C.). Control unit 70 can set the temperature of the heating surface as appropriate by the difference in gloss level of the recording medium. The temperature of the heating surface is set at 200° C. to 600° C., for example, when an image is formed on a recording medium with a high gloss level, and set at 300° C. to 700° C., for example, when an image is formed on a recording medium with a low gloss level.

Noncontact heating heater 61 that can be used may be such a heater as emitting far-infrared radiation such as a ceramic heater and the like in consideration of the difference in light absorption between black toner transferred onto the recording medium and a portion other than that (for example, toner of each color such as yellow, magenta and cyan transferred onto the recording medium or an image-unformed portion onto which toner is not transferred).

Heat insulation cover 62 is arranged with respect to noncontact heating heater 61 so as to cover noncontact heating heater 61 from the side opposite to the conveyance path of recording medium 90. The temperature around noncontact heating heater 61 is maintained at an elevated temperature by heat insulation cover 62, thereby allowing improvement in the heating efficiency of noncontact heating heater 61. Heat insulation cover 62 may be made of a material having high heat-insulating properties and high heat-resisting properties, such as a ceramic fiber. It is to be noted that heat insulation cover 62 is not necessarily provided, but can be omitted if it is unnecessary.

Airflow means (not shown) formed by a fan, a duct and the like may be provided around noncontact heating heater 61. The carrier solution (vapor) that has been volatilized from toner image 91 between noncontact heating heater 61 and recording medium 90 is discharged by the airflow means from the periphery of noncontact heating heater 61 to the outside. By the configuration as described above, even if the amount of volatilized carrier solution is increased, the vapor pressure of the carrier solution volatilized around the periphery of noncontact heating heater 61 can be effectively lowered to the saturation vapor pressure or lower.

Although noncontact heating heater 61 in the present embodiment is configured so as to heat recording medium 90 from the recording surface side onto which toner image 91 is transferred, it may be configured so as to heat recording medium 90 from the surface side opposite thereto.

Conveying unit 67 is disposed so as to face noncontact heating heater 61, and includes a driving roller 63, a driven roller 64, a suction belt 65, and a suction fan 66. The recording medium conveyed to noncontact heating device 60 is further conveyed by conveying unit 67 toward pressurizing and heating mechanism 50.

Suction belt 65 is configured in an annular shape using a high heat-resistance member such as silicone rubber, and wound around driving roller 63 and driven roller 64 that are arranged at a distance from each other in the direction in which recording medium 90 is conveyed (in the direction indicated by arrow AR90). Driving roller 63 and driven roller 64 each are formed of a roller made of metal such as aluminum. Driving roller 63 is rotary-driven, and in accordance with the rotation of driving roller 63, suction belt 65 rotates in the direction indicated by an arrow AR65. Driven roller 64 is driven to rotate through suction belt 65.

The rotation speed of driving roller 63 is controlled such that the surface of suction belt 65 moves at a desired speed. The positional relation in the direction in which driving roller 63 and driven roller 64 transfer recording medium 90 may be established such that driving roller 63 is arranged upstream and driven roller 64 is arranged downstream, or in contrast, such that driven roller 64 is arranged upstream and driving roller 63 is arranged downstream.

A suction fan 66 is provided inside suction belt 65. Suction fan 66 sucks recording medium 90 through a plurality of suction holes 65T provided in suction belt 65. Thereby, recording medium 90 is conveyed toward downstream while it is being adsorbed onto the surface of suction belt 65.

Pressurizing and heating mechanism 50 is arranged downstream of noncontact heating device 60 in the direction in which recording medium 90 is conveyed (in the direction indicated by arrow AR90), and includes a fixing roller 51 and a pressurizing roller 52 that are arranged so as to face each other across the conveyance path of recording medium 90. In the case where a recording medium with a high gloss level described later is used, pressurizing and heating mechanism 50 can fix the toner image transferred onto the recording medium with a high gloss level. In addition, pressurizing and heating mechanism 50 is not limited to the above-described roller type mechanism, but may be a belt-type mechanism.

Each of fixing roller 51 and pressurizing roller 52 has both ends that are supported by a bearing member (not shown) so as to be freely pivotable. Fixing roller 51 and pressurizing roller 52 are supported by pressing-contact/separation mechanism 53 having a cam or a spring such that these rollers 51 and 52 can be pressed in contact with each other with conveyance path of recording medium 90 interposed therebetween. Pressing-contact/separation mechanism 53 functions as a pressing-contact and separation mechanism.

Control unit 70 controls the above-described pressing-contact/separation mechanism 53, to switch between the state where fixing roller 51 and pressurizing roller 52 are arranged so as to be separated from each other (separated state) and the state where fixing roller 51 and pressurizing roller 52 are arranged such that these rollers 51 and 52 are biased so as to be pressed in contact with each other with the conveyance path of recording medium 90 interposed therebetween (pressed-contact state). In the state where fixing roller 51 and pressurizing roller 52 are arranged so as to be pressed in contact with each other with the conveyance path of recording medium 90 interposed therebetween, a pressed-contact nip portion is formed between fixing roller 51 and pressurizing roller 52. In this state, pressurizing roller 52 is rotary-driven by control unit 70 at a prescribed circumferential speed in the direction indicated by an arrow AR52 while fixing roller 51 receives the pressed-contact friction force from pressurizing roller 52 through the pressed-contact nip portion. Consequently, fixing roller 51 is driven to rotate in the direction indicated by an arrow AR51. In addition, fixing roller 51 may be configured to be rotary-driven, and pressurizing roller 52 may be configured to be driven to rotate.

In the case where double-side printing is carried out, both of fixing roller 51 and pressurizing roller 52 may be controlled so as to recede from the conveyance path of recording medium 90. Thereby, it becomes possible to achieve the above-described state where fixing roller 51 and pressurizing roller 52 are arranged so as to be separated from each other. Furthermore, in the case where single-side printing is carried out, only fixing roller 51 located on the record surface side of recording medium 90 may be controlled so as to recede from the conveyance path of recording medium 90, thereby achieving the state where fixing roller 51 and pressurizing roller 52 described above are arranged so as to be separated from each other.

In this case, image forming apparatus 1 in the present embodiment is configured to perform an operation in such a manner that recording medium 90 with a high gloss level is heated by noncontact heating device 60 and then pressurized and heated by pressurizing and heating mechanism 50, and to perform an operation in such a manner that recording medium 90 with a low gloss level is heated by noncontact heating device 60 and then caused to pass through pressurizing and heating mechanism 50 without being pressurized and heated by pressurizing and heating mechanism 50. The above-described operations are switched by control unit 70 that switches the state of pressurizing and heating mechanism 50 as described above. Specific manners of the printing operation will be described later.

Fixing roller 51 incorporates a heater lamp 51H (halogen lamp). The surface temperature of fixing roller 51 is set at a prescribed temperature (for example, 120° C. to 200° C.) by control unit 70.

Pressurizing roller 52 incorporates a heater lamp 52H (halogen lamp). The surface temperature of pressurizing roller 52 is set at a prescribed temperature (for example, 120° C. to 200° C.) by control unit 70.

Fixing roller 51 and pressurizing roller 52 each have a hollow cored bar made of metal having high heat conductivity such as aluminum (having a thickness of 0.5 mm to 5 mm), an elastic layer provided on the outer circumference of the metal cored bar for ensuring a nip width (having a thickness of 0.5 mm to 3 mm), and a release layer provided on the outer circumference of the elastic layer for enhancing the releasing performance of the surface (having a thickness of 10 μm to 50 μm). The elastic layer is made, for example, of silicone rubber. The release layer is made of a fluorine-based resin such as PTFE (polytetrafluoroethylene) or PFA (perfluoroalkoxy polymer).

Figure 3:
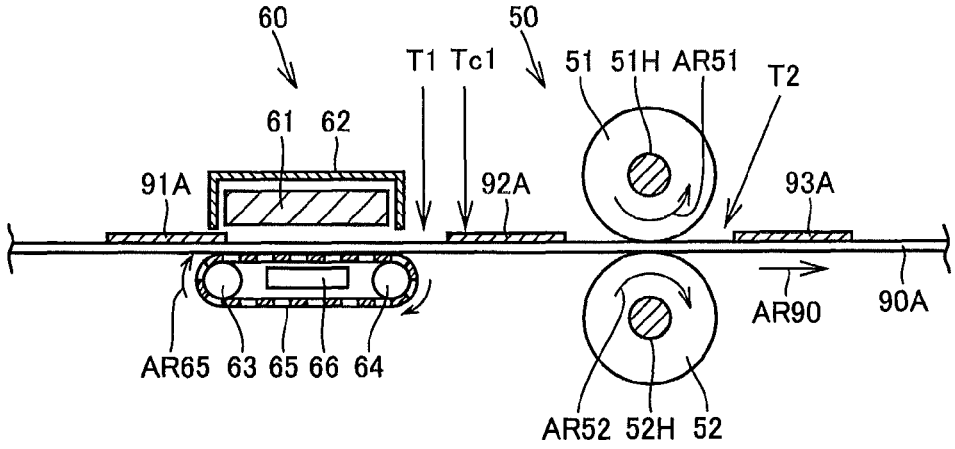
FIG. 3 is a schematic diagram for illustrating the operation at the time when the image forming apparatus shown in FIG. 1 fixes a toner image on a recording medium with a high gloss level.

FIG. 3 is a schematic diagram for illustrating the operation at the time when the image forming apparatus shown in FIG. 1 fixes a toner image on a recording medium with a high gloss level. Referring to FIG. 3, a description will be hereinafter made with regard to the operation at the time when image forming apparatus 1 fixes a toner image on a recording medium with a high gloss level.

As shown in FIG. 3, in the case where coated paper 90A is for example used as a recording medium with a high gloss level, control unit 70 controls pressing-contact/separation mechanism 53 described above such that fixing roller 51 and pressurizing roller 52 are arranged so as to be pressed in contact with each other with prescribed pressure with the conveyance path of recording medium 90 interposed therebetween. In this case, a toner image 91A transferred onto coated paper 90A is fixed on coated paper 90A by noncontact heating device 60 and pressurizing and heating mechanism 50.

First, coated paper 90A, onto which toner image 91A containing toner particles and a carrier solution is transferred, passes through noncontact heating device 60. Noncontact heating device 60 heats coated paper 90A and toner image 91A (toner particles and a carrier solution) on coated paper 90A mainly by radiation from noncontact heating heater 61. In this case, the carrier solution contained in toner image 91A is heated by noncontact heating device 60 and thereby partially volatilized, with the result that toner image 92A with the amount of the carrier solution decreased is formed on coated paper 90A.

Then, coated paper 90A reaches pressurizing and heating mechanism 50, and toner image 92A and coated paper 90A are pressurized and heated by fixing roller 51 and pressurizing roller 52. In this case, melting of toner particles contained in toner image 92A is promoted to cause integration of the melted toner particles, thereby forming an image 93A on coated paper 90A.

At this time, after the carrier solution in toner image 92A after noncontact heating (before completion of fixation) deposits on the surface of toner image 92A by being heated and pressurized, this carrier solution is removed by fixing roller 51, volatilized at the outlet of the pressed-contact nip portion, permeates into coated paper 90A, or remains in toner image 92A. In the presence of the carrier solution, under the influence of the hysteresis of the carrier solution existing on the surface of toner image 92A (the interface between toner image 92A and fixing roller 51) and/or the hysteresis of the carrier solution deposited on the surface of the toner image from within toner image 92A in the pressed-contact nip portion, the gloss level (smoothness) of image 93A finally formed from toner image 92A on recording medium 90 is determined.

Since the gloss level of coated paper 90A is generally approximately 70, it is preferable that the gloss level of image 93A after fixation is 60 or more and 80 or less in order to eliminate a feeling of strangeness experienced by a viewer due to the difference between the gloss level of image 93A after fixation and the gloss level of coated paper 90A.

When coated paper 90A is used in this way, image 93A with a high gloss level needs to be obtained. Accordingly, in pressurizing and heating mechanism 50, melting of toner particles contained in toner image 92A should be promoted to smoothen the toner image surface. Also, the surface temperature of each of fixing roller 51 and pressurizing roller 52 should be higher than the set temperature on the heating surface of noncontact heating heater 61. Accordingly, a temperature T2 [° C.] of coated paper 90A that has been pressurized and heated by pressurizing and heating mechanism 50 is higher than a temperature T1 [° C.] of coated paper 90A that has been heated by noncontact heating device 60. Therefore, image forming apparatus 1 in the present embodiment will satisfy the following equation (1):

$$T1 < T2 \qquad \text{Equation (1).}$$

Figure 4:
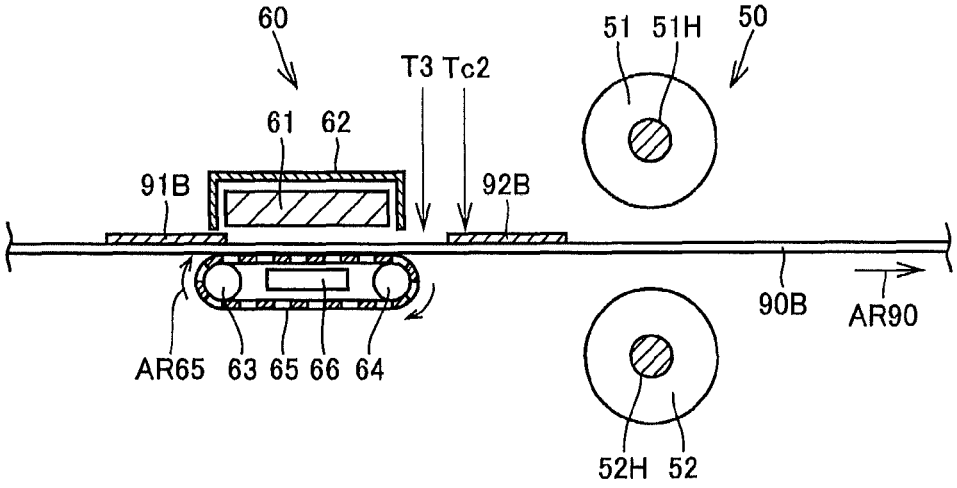
FIG. 4 is a schematic diagram for illustrating the operation at the time when the image forming apparatus shown in FIG. 1 fixes a toner image on a recording medium with a low gloss level.

FIG. 4 is a schematic diagram for illustrating the operation at the time when the image forming apparatus shown in FIG. 1 fixes a toner image on a recording medium with a low gloss level. Referring to FIG. 4, a description will be made with regard to the operation at the time when image forming apparatus 1 fixes a toner image on a recording medium with a low gloss level.

As shown in FIG. 4, in the case where fine quality paper 90B is for example used as a recording medium with a low gloss level, control unit 70 controls pressing-contact/separation mechanism 53 described above such that fixing roller 51 and pressurizing roller 52 are arranged so as to be separated from the conveyance path of fine quality paper 90B and located at a distance from each other. In this case, toner image 91B transferred onto fine quality paper 90B is fixed on fine quality paper 90B by noncontact heating device 60.

First, fine quality paper 90B, onto which toner image 91B containing toner particles and a carrier solution is transferred, passes through noncontact heating device 60. Noncontact heating device 60 heats fine quality paper 90B and toner image 91B (toner particles and a carrier solution) on this fine quality paper 90B mainly by radiation from noncontact heating heater 61. At this time, the toner particles contained in toner image 91B are melted and most of the carrier solution is volatilized. Consequently, an image 92B is formed on fine quality paper 90B. Then, fine quality paper 90B is caused to pass through between fixing roller 51 and pressurizing roller 52 arranged separated from each other without being pressurized and heated by these rollers 51 and 52.

Since the gloss level of fine quality paper 90B is generally approximately 5, it is preferable that the gloss level of image 92B after fixation is 15 or less in order to eliminate a feeling of strangeness experienced by a viewer due to the difference between the gloss level of image 92B after fixation and the gloss level of fine quality paper 90B.

When fine quality paper 90B is used, image 92B is formed on fine quality paper 90B only by noncontact heating device 60. Accordingly, in order to ensure the fixing strength for image 92B, the set temperature of noncontact heating device 60 should be raised as compared with the case where coated paper 90A is used. Consequently, a temperature T3 [° C.] of fine quality paper 90B immediately after being heated by noncontact heating device 60 and passing through noncontact heating device 60 is higher than temperature T1 [° C.] of coated paper 90A immediately after being heated by noncontact heating device 60 and passing through noncontact heating device 60. Therefore, image forming apparatus 1 in the present embodiment will satisfy the following equation (2):

$$T1 < T3 \qquad \text{Equation (2).}$$

As a method for satisfying the above-mentioned equation (2) explained in the above, the set temperature of noncontact heating device 60 is set to be relatively higher in the case where fine quality paper 90B is used as compared with the case where coated paper 90A is used, but the present invention is not limited to thereto. For example, the rotation speed of driving roller 63 of noncontact heating device 60 may be reduced such that the heat quantity transmitted to fine quality paper 90B becomes greater than the heat quantity transmitted to coated paper 90A. Also, in the configuration in which a plurality of noncontact heating devices 60 are provided, the operations of a plurality of noncontact heating devices 60 may be controlled such that all noncontact heating heaters 61 are driven when fine quality paper 90B is used, and such that at least one noncontact heating heater 61 is stopped when coated paper 90A is used. Furthermore, in the configuration in which noncontact heating heater 61 is movably supported, when fine quality paper 90B is used, control unit 70 may control the operation of noncontact heating heater 61 such that the distance between fine quality paper 90B and noncontact heating heater 61 is shorter than the distance between coated paper 90A and noncontact heating heater 61, as compared with the case where coated paper 90A is used. Furthermore, the above-described configurations may be combined.

On the other hand, when fine quality paper 90B is used, image 92B is formed on fine quality paper 90B only by noncontact heating device 60. Accordingly, almost all of the carrier solution on fine quality paper 90B needs to be volatilized immediately after passing through noncontact heating device 60. On the other hand, when coated paper 90A is used, in order to prevent occurrence of an image noise (offsetting phenomenon) due to adhesion of the melted toner particles onto fixing roller 51, a prescribed amount of carrier solution needs to remain on coated paper 90A immediately after passing through noncontact heating device 60. For that purpose, a toner concentration Tc2 [weight %] after fine quality paper 90B is heated by noncontact heating device 60 needs to be higher than a toner concentration Tc1 [weight %] after coated paper 90A is heated by noncontact heating device 60. Therefore, image forming apparatus 1 in the present embodiment will satisfy the following equation (3):

$$Tc1<Tc2 \qquad \text{Equation (3).}$$

It is to be noted that toner concentration Tc [weight %] is defined by the value obtained by dividing the weight of toner contained in the toner image immediately after passing through noncontact heating device 60 by the sum of the toner weight and the carrier solution weight on the recording medium.

Figure 5:
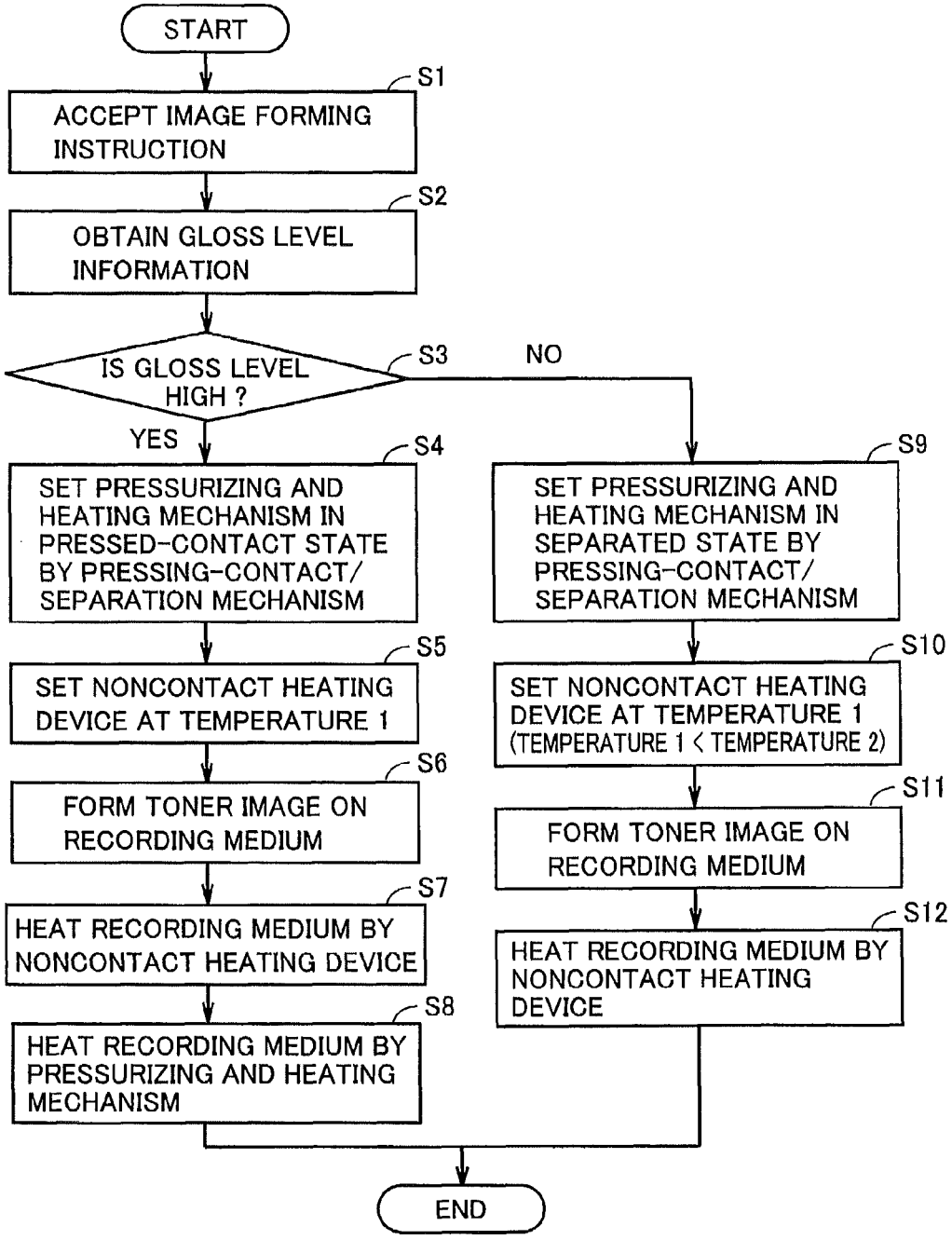
FIG. 5 is a flow diagram showing a fixing operation of the image forming apparatus shown in FIG. 1.

FIG. 5 is a flow diagram showing a fixing operation of the image forming apparatus shown in FIG. 1. Referring to FIG. 5, the fixing operation as described above will be hereinafter summarized.

As shown in FIG. 5, in step (S1), control unit 70 accepts an image forming instruction. Thereby, a recording medium is conveyed from a recording medium feeding unit (not shown). Then, in step (S2), gloss level detection unit 84 serving as an obtaining unit detects the gloss level of the recording medium conveyed on the conveyance path. The detected gloss level information of the recording medium is input into control unit 70.

Then, in step (S3), control unit 70 determines based on the input gloss level information whether the gloss level information of the recording medium shows high gloss or not. When the gloss level information of the recording medium shows high gloss (step 3; YES), control unit 70 performs step (S4). On the other hand, when the gloss level information of the recording medium shows low gloss (step 3; NO), control unit 70 performs step (S9).

Then, in step (S4), control unit 70 controls the operation of pressing-contact/separation mechanism 53 to set fixing roller 51 as a heating member and pressurizing roller 52 as a pressurizing member in such a state that these rollers are biased to be pressed in contact with each other with the conveyance path of the recording medium interposed therebetween (pressed-contact state). Then, in step (S5), control unit 70 sets the temperature of the heating surface of noncontact heating heater 61 in noncontact heating device 60 at a desired temperature 1.

Then, in step (S6), control unit 70 causes developing device 10 serving as a developing mechanism to develop a toner image on image carrier 20. Also, control unit 70 causes the toner image developed on image carrier 20 to be transferred onto an intermediate transfer body, and causes the recording medium to pass through the contact portion between intermediate transfer body 30 and backup member 40, so that the toner image is transferred onto the recording medium.

Then, in step (S7), control unit 70 causes noncontact heating device 60 to heat the recording medium conveyed to the fixing unit. Then, in step (S8), control unit 70 causes the recording medium to pass through the pressed-contact nip portion formed by fixing roller 51 and pressurizing roller 52 pressed in contact with each other, thereby causing pressurizing and heating mechanism 50 to pressurize and heat the recording medium.

On the other hand, when the gloss level information of the recording medium shows low gloss, in step (S9), control unit 70 controls the operation of pressing-contact/separation mechanism 53 to bring about a separated state where fixing roller 51 and pressurizing roller 52 are separated from the conveyance path of the recording medium so as to be not in contact with each other.

Then, in step (S10), control unit 70 sets the temperature of the heating surface of noncontact heating heater 61 in noncontact heating device 60 at a desired temperature 2. In this case, temperature 1 and temperature 2 described above establish the relation of temperature 1<temperature 2.

Then, in step (S11), control unit 70 causes the toner image to be transferred onto the recording medium by the same method as in step (S6).

Then, in step (S12), control unit 70 controls the operations of noncontact heating device 60 and pressurizing and heating mechanism 50 such that the recording medium conveyed to the fixing unit is heated by noncontact heating device 60 and then caused to pass through pressurizing and heating mechanism 50 in the separated state.

Although the flow of the fixing operation as described above has been explained by way of illustration in the present embodiment, the flow is not limited to this order, but the order of the steps can be changed within the scope without deviating from the intention of the present invention. For example, the order of step (S4) and step (S5) may be switched or the order of step (S9) and step (S10) may be switched.

According to image forming apparatus 1 and the image forming method in the present embodiment as described above, control unit 70 controls noncontact heating device 60 and pressurizing and heating mechanism 50 to satisfy the above-mentioned equations (1) to (3). Consequently, even if a plurality of recording media with different gloss levels are used, the difference between the gloss level of the recording medium itself and the gloss level of the image fixed on the recording medium can be suppressed to fall within a desired acceptable range, thereby allowing improvement in the image quality on the recording medium.

(Verification Experiment 1)

Then, verification experiment 1 will be described that verified whether the gloss level of the image formed on the recording medium using noncontact heating device 60 and pressurizing and heating mechanism 50 falls within a desired acceptable range or not in the case where the recording medium with a high gloss level is used.

In the present verification experiment, the volume average particle diameter of the toner particles was 2 μm, and the proportion of the weight of the toner particles to the weight of the liquid developer used in developing device 10 was 30 weight %. In this case, toner concentration Tc1 of the toner image on recording medium 90 after being heated by noncontact heating device 60 was adjusted at 54 weight % or 72 weight %.

Furthermore, coated paper 90A was used as recording medium 90, toner A was used as toner, IP2028 (manufactured by Idemitsu Kosan Co., Ltd.) was used as a carrier solution, and pressure P applied when pressurizing a toner image was set at 500 KPa. In this case, toner A is made of polyester resin and has an average particle diameter of 2 μm.

Under the above-described conditions, the gloss level of the image after pressurization and heating (after fixation) was measured in the case where recording medium temperature T2 after pressurization and heating (after fixation) was adjusted at 125° C., 140° C. and 155° C.

Figure 6:
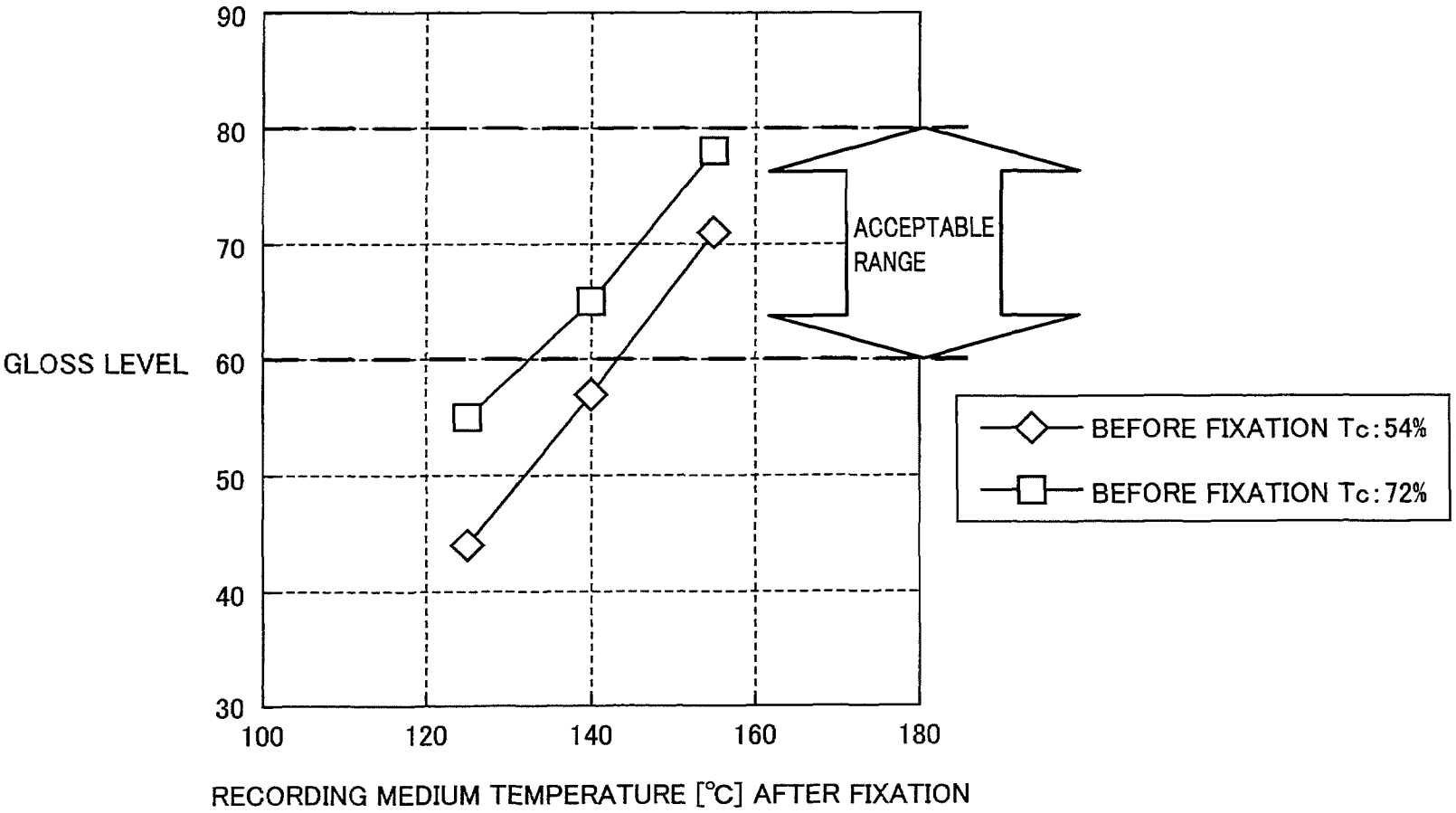
FIG. 6 is a diagram showing results of verification experiment 1.

FIG. 6 is a diagram showing the results of verification experiment 1, and specifically, a diagram showing the relation between the gloss level of the image after fixation and the recording medium temperature after fixation in the case where the recording medium with a high gloss level was used to change the toner concentration before completion of fixation.

As shown in FIG. 6, in either case where toner concentration Tc1 after noncontact heating (before completion of fixation) was 54 weight % or 72 weight %, it was confirmed that the difference between the gloss level of the recording medium itself and the gloss level of the image fixed on the recording medium could fall within a desired acceptable range.

Furthermore, when toner concentration Tc1 was 72 weight %, the gloss level of the image after fixation was entirely relatively higher, as compared with the case where toner concentration Tc1 was 54 weight %. Therefore, it was found that the gloss level of image 93A formed on coated paper 90A was influenced by toner concentration Tc1 [weight %] in toner image 92A on coated paper 90A after passing through noncontact heating device 60 and before passing through pressurizing and heating mechanism 50, and the difference between the gloss level of the recording medium itself and the gloss level of the image fixed on the recording medium could be suppressed to fall within a desired acceptable range by properly controlling toner concentration Tc1 [weight %].

(Verification Experiment 2)

Then, verification experiment 2 will be described that verified whether the gloss level of the image formed on the recording medium using only noncontact heating device 60 falls within a desired acceptable range or not in the case where a recording medium with a low gloss level is used.

Specifically, the gloss level of the image formed when a toner image was fixed on the recording medium with low gloss only by noncontact heating device 60 and the gloss level of the image formed when a toner image was fixed on the recording medium with low gloss by both of noncontact heating device 60 and pressurizing and heating mechanism 50 were compared.

In the present verification experiment, the volume average particle diameter of the toner particles was set at 2 μm, and the proportion of the weight of the toner particles to the weight of the liquid developer used in developing device 10 was set at 30 weight %. In this case, fine quality paper 90B was used as recording medium 90, toner A described above was used as toner, IP2028 was used as a carrier solution, and pressure applied when pressurizing a toner image was set at 500 KPa.

Under the above-described conditions, the gloss level of the image after fixation was measured in the case where the recording medium temperature after noncontact heating or after pressurization and heating was adjusted at 100° C., 110° C., 120° C., and 130° C.

Figure 7:
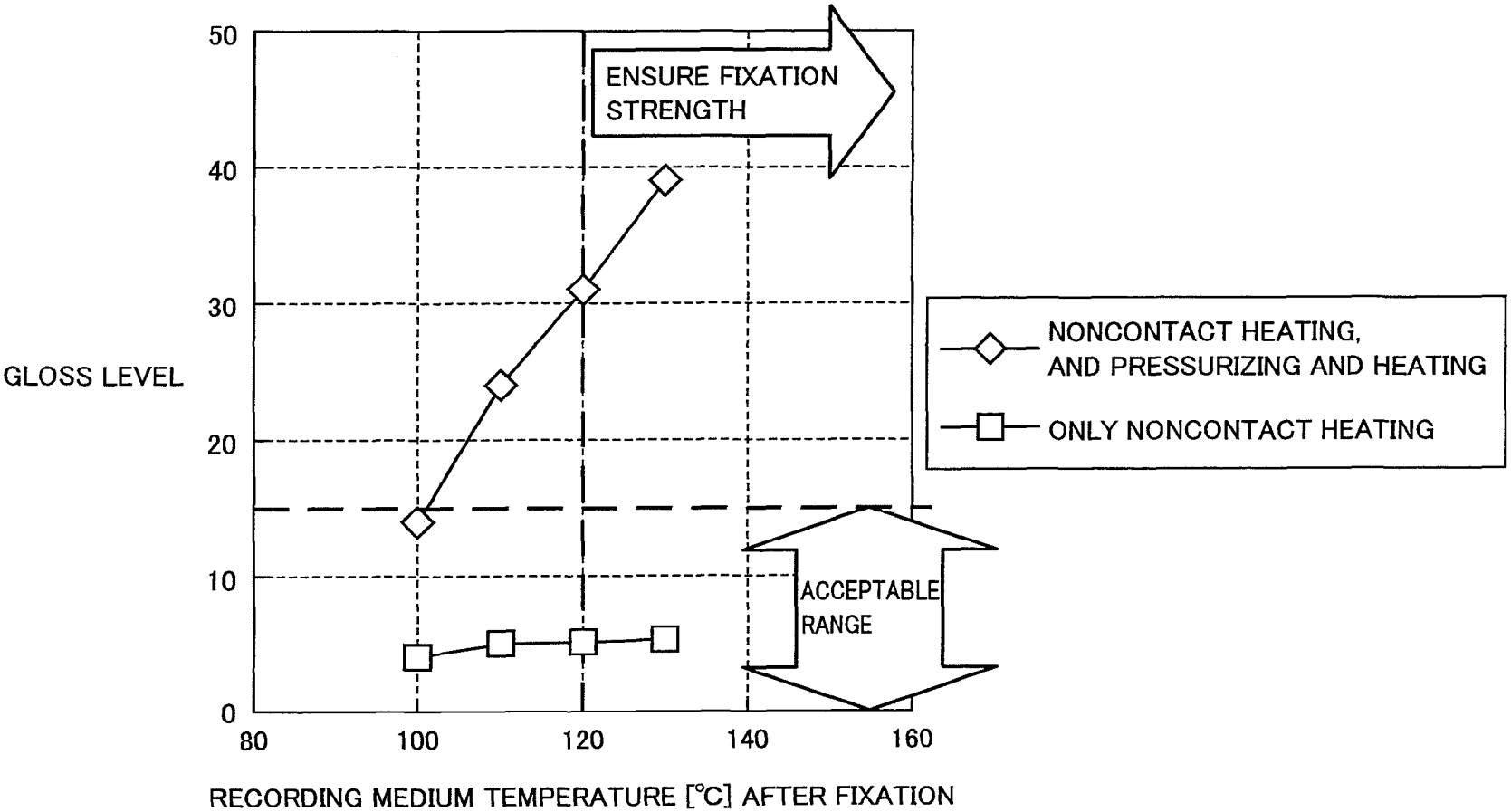
FIG. 7 is a diagram showing results of verification experiment 2.

FIG. 7 is a diagram showing the results of verification experiment 2, and specifically, a diagram showing the relation between the gloss level of the image after fixation and the recording medium temperature after fixation, in each of the case where only noncontact heating device 60 is used and the case where both of noncontact heating device 60 and pressurizing and heating mechanism 50 are used, when a toner image is fixed on a recording medium with a low gloss level.

As shown in FIG. 7, it was confirmed that the difference between the gloss level of the recording medium itself and the gloss level of the image fixed on the recording medium can be suppressed to fall within a desired acceptable range by heating only with noncontact heating device 60, when a recording medium with a low gloss level is used.

Specifically, when a toner image was fixed by noncontact heating device 60, the gloss level of the image after fixation was entirely relatively low, with the result that the gloss level of the image after fixation fell within the range of the desired gloss level at which a viewer did not experience a feeling of strangeness (the gloss level was 15 or lower). Furthermore, even if the toner particles were melted to the temperature at which a desired fixing strength could be ensured (the recording medium temperature after fixation was 120° C. or higher), the toner image surface was not flattened. Accordingly, the difference between the gloss level (smoothness) of the recording medium itself and the gloss level of the image finally formed on recording medium 90 was relatively small, with the result that this difference between the gloss levels could be suppressed to fall within a desired acceptable range.

On the other hand, when the toner image was fixed by noncontact heating device 60 and pressurizing and heating mechanism 50, the gloss level of the image after fixation was entirely relatively high, with the result that the gloss level of the image after fixation deviated from the range of the desired gloss level (the gloss level was 15 or lower) in which a viewer did not experience a feeling of strangeness at and around the recording medium temperature after fixation of 100° C. or higher. Particularly, when the toner particles were melted to the temperature at which the desired fixing strength could be ensured (the recording medium temperature after fixation was 120° C. or higher), the gloss level of the image becomes too high, thereby increasing the difference between the gloss level (smoothness) of the recording medium itself and the gloss level of the image finally formed on the recording medium.

Based on the results of verification experiments 1 and 2 as having been described above, it can be recognized as having been experimentally confirmed that image forming apparatus 1 in the present embodiment is employed to switch between execution and non-execution of the fixing operation by pressurizing and heating mechanism 50 while satisfying the above-mentioned equations (1) to (3) in response to the difference between the gloss levels of the recording media, thereby allowing the difference between the gloss level of the recording medium itself and the gloss level of the image fixed on the recording medium to be suppressed to fall within a desired acceptable range, with the result that the image quality on the recording medium can be improved.

As in verification experiment 1 described above, when a recording medium with high gloss is used, the gloss level of the image after pressurization and heating (after fixation) is greatly influenced by toner concentration Tc1 [weight %] of the toner image after noncontact heating (before completion of fixation). On the other hand, toner concentration Tc1 [weight %] with respect to the gloss level is generally influenced by recording medium temperature T2 [° C.] after fixation, pressure P [KPa] applied when pressurizing a toner image (fixation pressure), volatility of the carrier solution, a toner melting temperature Tm [° C.], and a toner melting temperature η [Pa·S].

Thus, in order to derive the relation between toner concentration Tc1 [weight %] and each parameter described above, experiments 1 to 5 described below were further conducted using the recording medium with high gloss. In each experiment, the volume average particle diameter of the toner particles was set at 2 μm, and the proportion of the weight of the toner particles to the weight of the liquid developer used in developing device 10 was set at 30 weight %.

In experiment 1, the gloss level is evaluated using the recording medium temperature after fixation and toner concentration Tc before completion of fixation as parameters, to thereby derive a lower limit value of toner concentration Tc before completion of fixation for ensuring the gloss level with respect to the recording medium temperature after fixation.

In experiment 2, fixation pressure different from that in experiment 1 is used to calculate the relationship of the fixation pressure with the lower limit value of toner concentration Tc before completion of fixation for ensuring the gloss level.

In experiment 3, the carrier solution having volatility different from that of the carrier solution used in each of experiments 1 and 2 is used to calculate the relationship of the volatility of the carrier solution with the lower limit value of toner concentration Tc before completion of fixation for ensuring the gloss level.

In experiment 4, the toner different in a melting temperature from the toner used in each of experiments 1 and 2 is used to calculate the relationship of the toner melting temperature with the lower limit value of toner concentration Tc before completion of fixation for ensuring the gloss level.

In experiment 5, the toner different in melt viscosity from the toner used in each of experiments 1 and 2 is used to calculate the relationship of the toner melt viscosity with the lower limit value of toner concentration Tc before completion of fixation for ensuring the gloss level. Details will be hereinafter described.

(Experiment 1)

Figure 8:
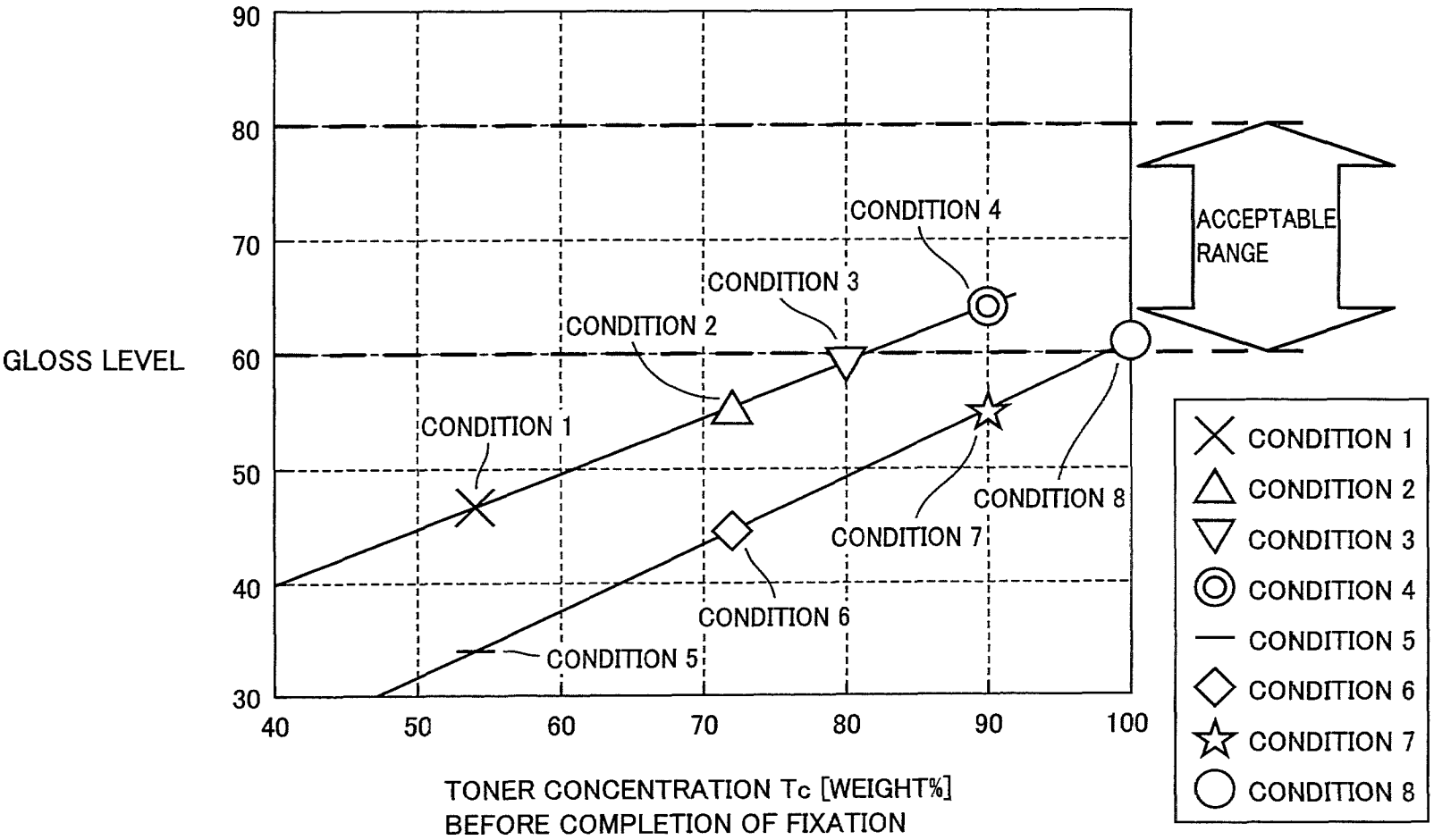
FIG. 8 is a diagram showing results of experiment 1.

First, experiment 1 was conducted in order to derive the relation between toner concentration Tc1 [weight %] of the toner image after noncontact heating (before completion of fixation) and recording medium temperature T2 [° C.] after fixation. FIG. 8 is a diagram showing results of experiment 1, and FIG. 9 is a diagram showing conditions and results of experiment 1.

As shown in FIG. 9, the image fixation conditions in experiment 1 were as follows: coated paper 90A was used as recording medium 90, toner A described above was used as toner, IP2028 was used as a carrier solution, and pressure P applied when pressurizing a toner image (fixation pressure) was set at 400 KPa. Furthermore, recording medium temperature T2 after fixation was adjusted at 125° C. or 140° C.

Under the above-described fixation conditions, image formation was carried out such that toner concentration Tc1 [weight %] before completion of fixation reached a value shown in each of conditions 1 to 8 as shown in FIG. 9, and then, the gloss level of the image after fixation under each of conditions 1 to 8 was measured.

Consequently, the gloss levels as shown in FIG. 9 were obtained under conditions 1 to 8. In particular, as shown in FIG. 8, the difference between the gloss level of the recording medium itself and the gloss level of the image fixed on the recording medium could be suppressed to fall within a desired acceptable range under conditions 4 and 8.

Furthermore, it was found from the results of experiment 1 that the relation between toner concentration Tc1 [weight %] before completion of fixation and the gloss level of the image shows linear relationship as shown in FIG. 8 when recording medium temperature T2 after fixation is the same. Based on FIG. 8, when calculating the lower limit Tc (min) (P=400) [weight %] of toner concentration Tc1 [weight %] at which the difference between the gloss level of the recording medium itself and the gloss level of the image fixed on the recording medium could be suppressed to fall within a desired acceptable range (the value of the toner concentration in the case where the gloss level of the image was 60), this lower limit of the toner concentration was 98.0 weight % when recording medium temperature T2 after fixation was 125° C., and 81.0 weight % when the recording medium temperature after fixation was 140° C.

Figure 10:
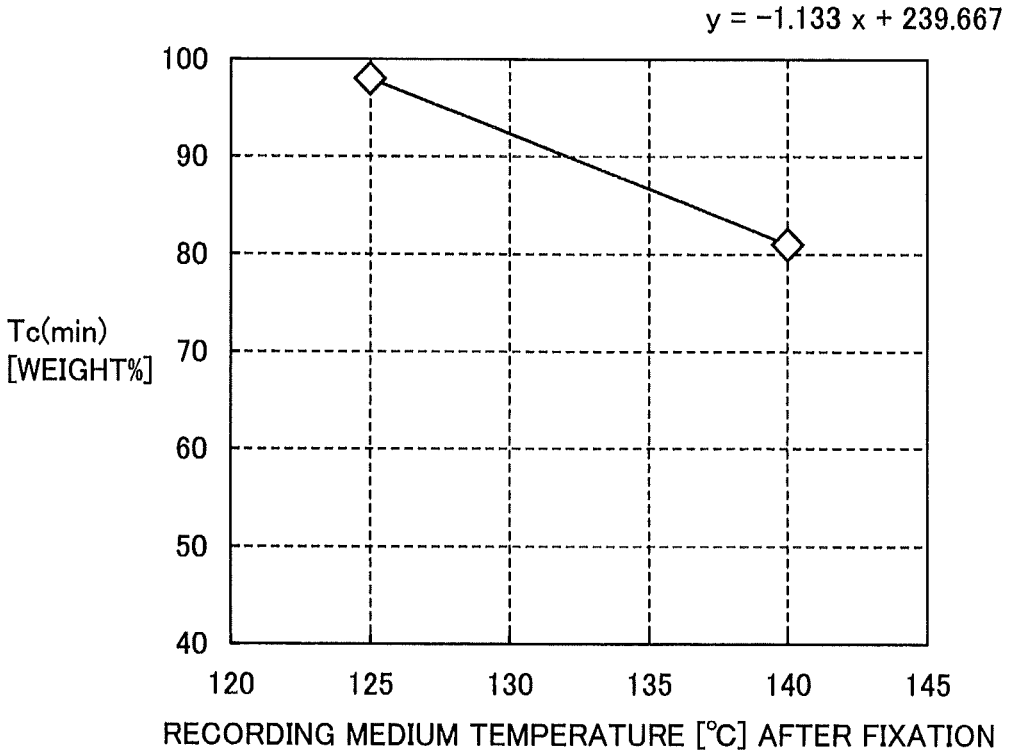
FIG. 10 is a graph showing a relational expression conceivable in consideration of the results of experiment 1 shown in FIG. 8.

FIG. 10 is a graph showing a relational expression conceivable in consideration of the results of experiment 1 shown in FIG. 8. Based on the above-described results, it was found that the relation between Tc (min) (y) [weight %] and recording medium temperature T2 (x) [° C.] after fixation was approximated by the following equation (A), as shown in FIG. 10.

$$y=-1.133x+239.667 \qquad \text{Equation (A)}$$

(Experiment 2)

Figure 11:
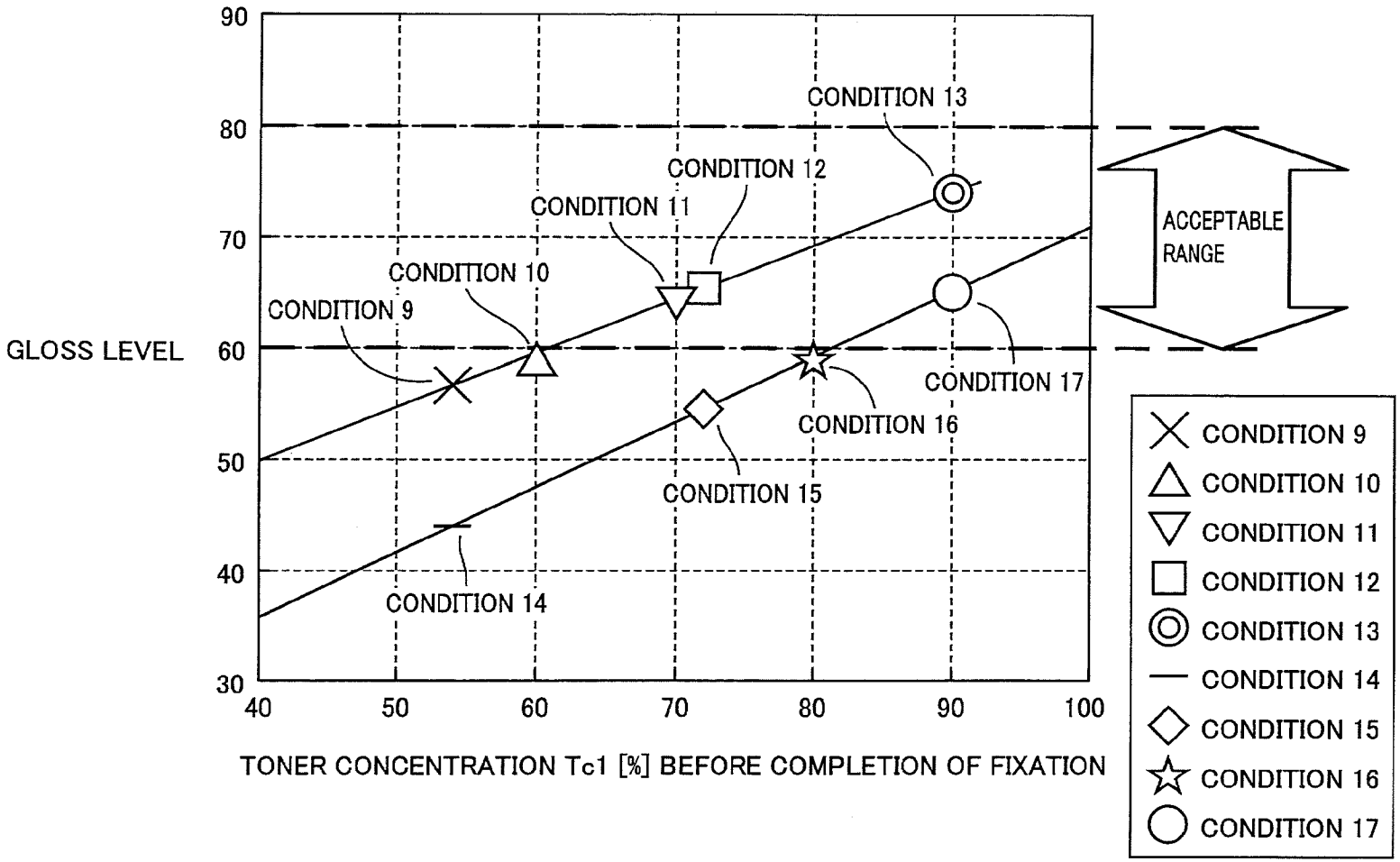
FIG. 11 is a diagram showing results of experiment 2.

Then, experiment 2 was conducted for deriving the relation between toner concentration Tc1 [weight %] of the toner image after noncontact heating (before completion of fixation) and the pressure (fixation pressure) P [KPa] applied when pressurizing a toner image. FIG. 11 is a diagram showing the results of experiment 2, and FIG. 12 is a diagram showing the conditions and the results of experiment 2.

As shown in FIG. 12, the image fixation conditions in experiment 2 are different in pressure P applied when pressurizing a toner image from those in experiment 1. Specifically, coated paper 90A was used as recording medium 90, toner A described above was used as toner, IP2028 was used as a carrier solution, and pressure (fixation pressure) P applied when pressurizing a toner image was set at 500 KPa. Furthermore, recording medium temperature T2 after fixation was adjusted at 125° C. or 140° C.

Under the above-described fixation conditions, image formation was carried out such that toner concentration Tc [weight %] before completion of fixation reached a value shown in each of conditions 9 to 17 as shown in FIG. 12, and then, the gloss level of the image after fixation under each of conditions 9 to 17 was measured.

Consequently, the gloss levels as shown in FIG. 12 were achieved under conditions 9 to 17 from comparative example 9. In particular, as shown in FIG. 11, the difference between the gloss level of the recording medium itself and the gloss level of the image fixed on the recording medium could be suppressed to fall within a desired acceptable range under conditions 11 to 13 and 17.

It was also found from the results of experiment 2 that the relation between toner concentration Tc1 [weight %] before completion of fixation and the gloss level of the image shows linear relationship as shown in FIG. 11 when recording medium temperature T2 after fixation is the same. Based on FIG. 11, when calculating the lower limit Tc (min) (P=500) [weight %] of toner concentration Tc1 [weight %] at which the difference between the gloss level of the recording medium itself and the gloss level of the image fixed on the recording medium could be suppressed to fall within a desired acceptable range (the value of the toner concentration in the case where the gloss level of the image was 60), this lower limit of the toner concentration was 81.0 weight % when recording medium temperature T2 after fixation was 125° C., and 61.0 weight % when recording medium temperature T2 after fixation was 140° C.

Figure 13:
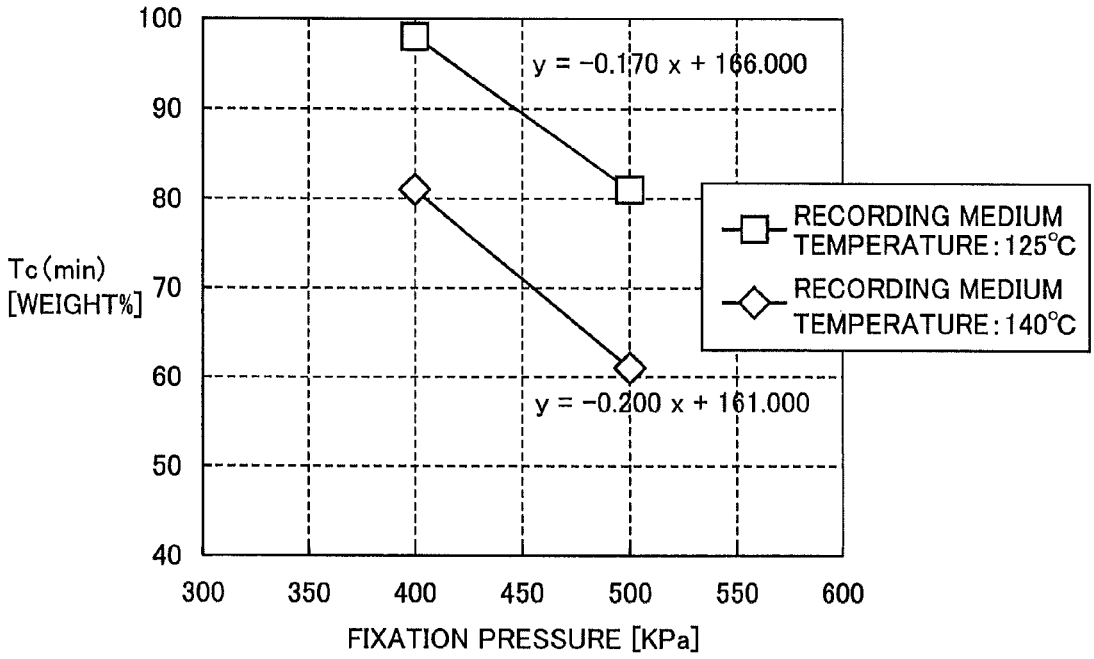
FIG. 13 is a graph showing the relational expression conceivable in consideration of the results of experiment 1 shown in FIG. 8 and the results of experiment 2 shown in FIG. 11.

FIG. 13 is a graph showing a relational expression conceivable in consideration of the results of experiment 1 shown in FIG. 8 and the results of experiment 2 shown in FIG. 11. It turned out from the results of experiments 1 and 2 that, when recording medium temperature T2 after fixation reaches 125° C. or 140° C., the linear relationship between lower limit value Tc (min) [weight %] of the toner concentration before completion of fixation at which the difference in gloss level between the recording medium itself and the image can be suppressed to fall within a desired acceptable range and pressure P [KPa] applied when pressurizing a toner image shows the relation as shown in FIG. 13.

As shown in FIG. 13, it was found that, when recording medium temperature T2 after fixation reaches 125° C., the relation between lower limit value Tc (min) (T2=125) (y) [weight %] of the toner concentration before completion of fixation at which the difference in gloss level between the recording medium itself and the image can be suppressed to fall within a desired acceptable range and pressure P (x) [KPa] applied when pressurizing a toner image is expressed by the approximate equation of the following equation (B).

$$y=-0.17x+166.0 \quad \text{Equation (B)}$$

Furthermore, it was found that, when recording medium temperature T2 after fixation reaches 140° C., the relation between lower limit value Tc (min) (T2=140) (y) [weight %] of the toner concentration before completion of fixation at which the difference in gloss level between the recording medium itself and the image can be suppressed to fall within a desired acceptable range and pressure P (x) [KPa] applied when pressurizing a toner image is expressed by the approximate equation of the following equation (C).

$$y=-0.200x+161.0 \quad \text{Equation (C)}$$

In other words, it was found that, when recording medium temperature T2 after fixation reaches 125° C. or 140° C., the value of Tc (min) in the case where pressure P applied when pressurizing a toner image is set as an arbitrary value is expressed by the following equation (D) in the case where the value of Tc (min) (P=400) at the time when pressure P applied when pressurizing a toner image is 400 KPa is set as a reference value.

$$Tc(\text{min})=Tc(\text{min})(P=400)+(\text{gradient shown in equation }(B)\text{ or equation }(C))\times(P-400) \quad \text{Equation (D)}$$

Figure 14:
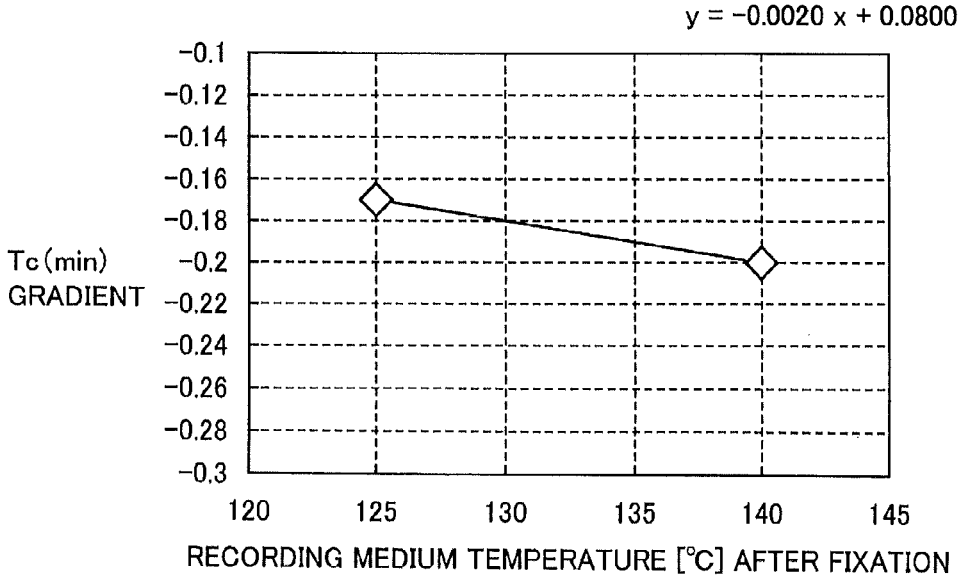
FIG. 14 is a diagram showing the relation between the gradient in the relational expression shown in FIG. 13 and a recording medium temperature after fixation.

FIG. 14 is a diagram showing the relation between the gradient in the relational expression shown in FIG. 13 and a recording medium temperature after fixation. It was found from the results shown in FIG. 13 that the relation between the gradient (Tc (min) gradient) (y) shown in the above-described approximate equation at an arbitrary temperature of the recording medium after fixation and recording medium temperature T2 (x) after fixation shows linear relationship as shown in FIG. 14, and this relation is approximated by the following equation (E):

$$y=-0.002x+0.08 \quad \text{Equation (E).}$$

Therefore, by substituting (gradient shown in equation (B) or equation (C)) in the above-mentioned equation (D) with the equation (E), in consideration of recording medium temperature T2 after fixation and fixation pressure P, it becomes possible to calculate lower limit value Tc (min) of the toner concentration before completion of fixation at which the difference in gloss level between the recording medium itself and the image can be suppressed to fall within a desired acceptable range.

Based on the results as described above, when toner concentration Tc1 before completion of fixation satisfies the following equation (F), the difference between the gloss level of the recording medium itself and the gloss level of the image fixed on the recording medium can be suppressed to fall within a desired acceptable range, thereby allowing improvement in the image quality on the recording medium.

$$Tc1\geq-1.133\times T2+239.667+(-0.002\times T2+0.08)\times(P-400) \quad \text{Equation (F)}$$

(Experiment 3)

Figure 15:
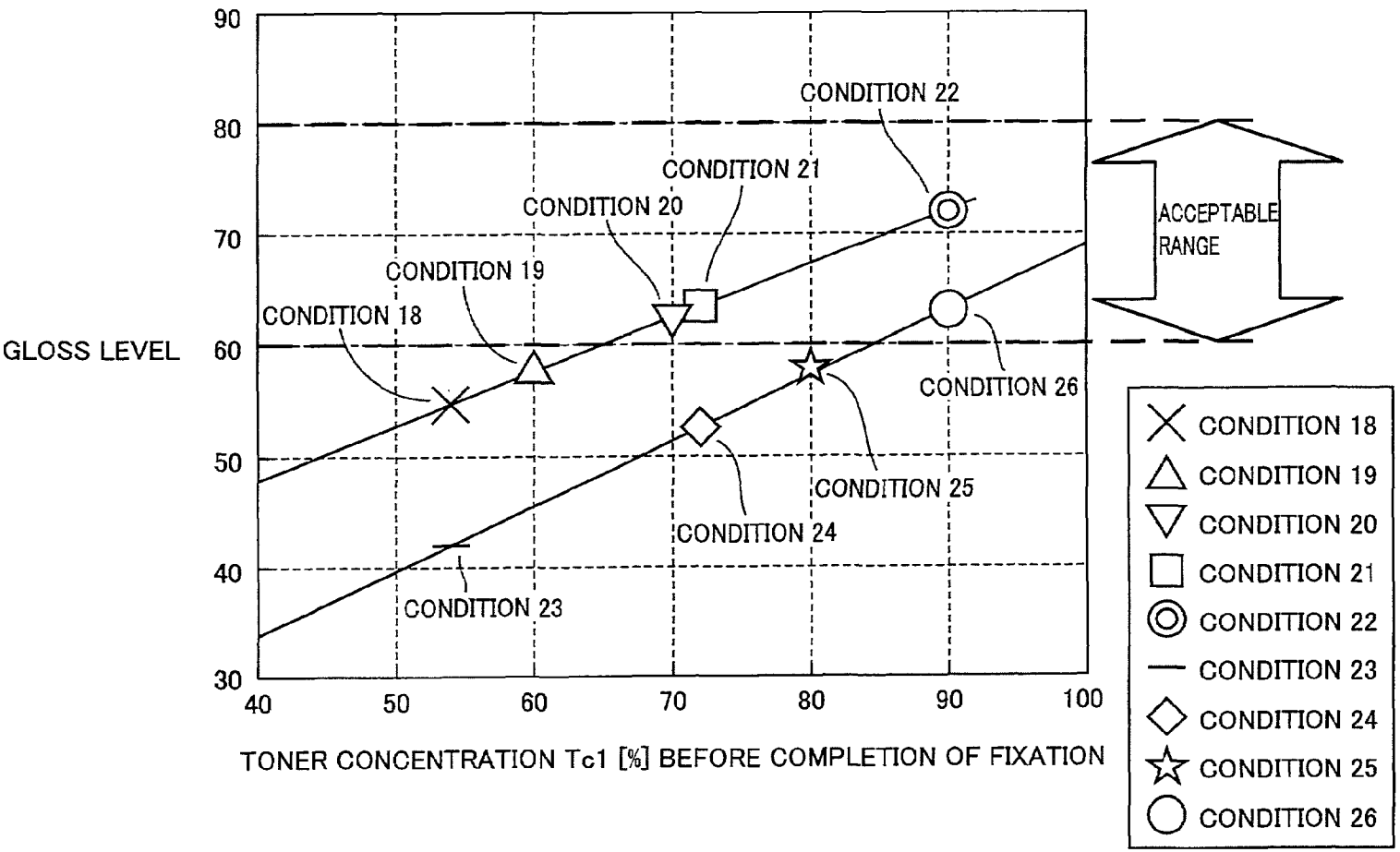
FIG. 15 is a diagram showing results of experiment 3.

Then, experiment 3 was conducted for deriving the relation between toner concentration Tc1 [weight %] of the toner image after noncontact heating (before completion of fixation) and the carrier solution volatility. In this case, the carrier solution volatility is influenced by a center value C of the carbon number of molecules constituting a carrier solution. FIG. 15 is a diagram showing results of experiment 3, and FIG. 16 is a diagram showing conditions and results of experiment 3.

As shown in FIG. 16, as compared with experiment 1, the fixation conditions of the image in experiment 3 are different in toner concentration Tc1 before completion of fixation, and mainly different in type of the carrier solution. Coated paper 90A was used as recording medium 90, toner A described above was used as toner, Isopar-L (manufactured by Exxon Mobil Corporation) was used as a carrier solution, and pressure P applied when pressurizing a toner image was set at 400 KPa. Furthermore, recording medium temperature T2 after fixation was adjusted at 125° C. or 140° C. Furthermore, carrier solution IP2028 and carrier solution Isopar-L are different in center value C of the carbon number of molecules constituting the carrier solution. Center value C of the carbon number of molecules constituting carrier solution IP2028 is 16 while center value C of the carbon number of molecules constituting carrier solution Isopar-L is 12.

Under the above-described fixation conditions, image formation was carried out such that toner concentration Tc1 [weight %] before completion of fixation reached a value shown in each of conditions 18 to 26 as shown in FIG. 16, and then, the gloss level of the image after fixation under each of conditions 18 to 26 was measured.

Consequently, the gloss levels as shown in FIG. 16 were achieved under conditions 18 to 26. In particular, as shown in FIG. 15, the difference between the gloss level of the recording medium itself and the gloss level of the image fixed on the recording medium could be suppressed to fall within a desired acceptable range under conditions 20 to 22 and 26.

Furthermore, it was found from the results of experiment 3 that the relation between toner concentration Tc1 [weight %] before completion of fixation and the gloss level of the image shows linear relationship as shown in FIG. 15 when recording medium temperature T2 after fixation is the same. Based on FIG. 15, when calculating lower limit Tc (min) (C=12) of toner concentration Tc [weight %] at which the difference between the gloss level of the recording medium itself and the gloss level of the image fixed on the recording medium could be suppressed to fall within a desired acceptable range (the value of the toner concentration in the case where the gloss level of the image was 60), this lower limit of the toner concentration was 85.0 weight % when recording medium temperature T2 after fixation was 125° C., and 65.0 weight % when recording medium temperature T2 after fixation was 140° C.

Figure 17:
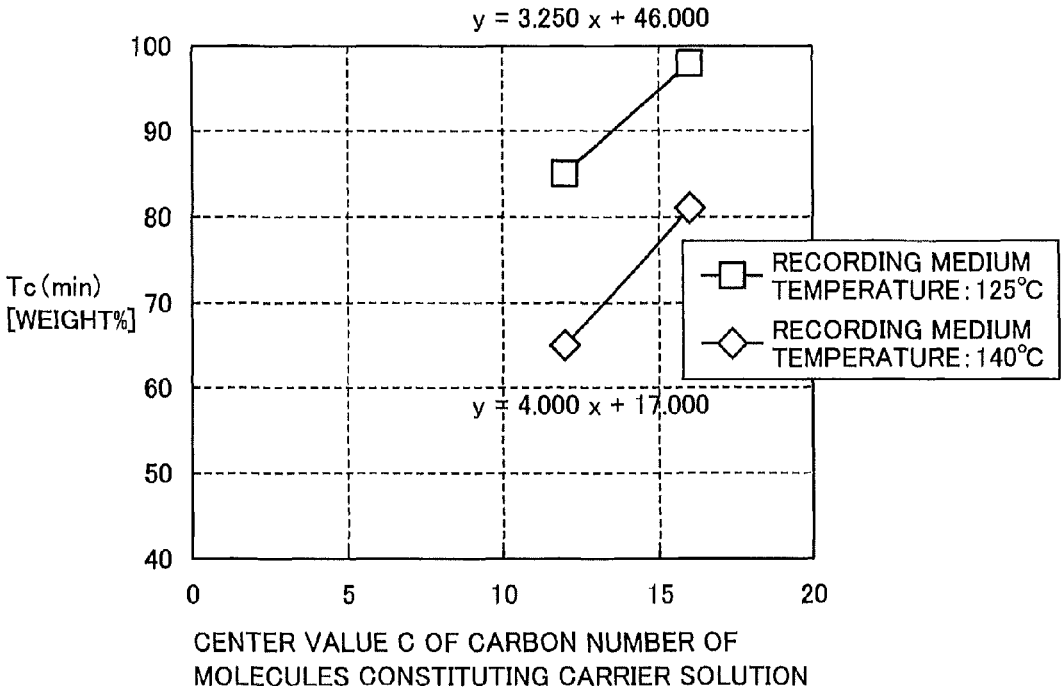
FIG. 17 is a graph showing a relational expression conceivable in consideration of the results of experiment 1 shown in FIG. 8 and the results of experiment 3 shown in FIG. 15.

FIG. 17 is a graph showing a relational expression conceivable in consideration of the results of experiment 1 shown in FIG. 8 and the results of experiment 3 shown in FIG. 15. It turned out from the results of experiments 1 and 3 that, in the case where the recording medium temperature after fixation reaches 125° C. or 140° C., the linear relationship between lower limit value Tc (min) of the toner concentration before completion of fixation at which the difference in gloss level between the recording medium itself and the image can be suppressed to fall within a desired acceptable range and center value C of the carbon number of molecules constituting the carrier solution shows the relation as shown in FIG. 17.

As shown in FIG. 17, it was found that, in the case where recording medium temperature T2 after fixation reaches 125° C., the relation between lower limit value Tc (min) (T2=125) (y) [weight %] of the toner concentration before completion of fixation at which the difference in gloss level between the recording medium itself and the image can be suppressed to fall within a desired acceptable range and center value C (x) of the carbon number of molecules constituting the carrier solution is expressed by the approximate equation of the following equation (G):

$$y=3.25x+46.0 \quad \text{Equation (G).}$$

Furthermore, it was found that, in the case where recording medium temperature T2 after fixation reaches 140° C., the relation between lower limit value Tc (min) (T2=140) (y) [weight %] of the toner concentration before completion of fixation at which the difference in gloss level between the recording medium itself and the image can be suppressed to fall within a desired acceptable range and center value C (x) of the carbon number of molecules constituting the carrier solution is expressed by the approximate equation of the following equation (H):

$$y=4.00x+17.0 \quad \text{Equation (H).}$$

In other words, it was found that, in the case where recording medium temperature T2 after fixation is 125° C. or 140° C., the value of Tc (min) at the time when center value C of the carbon number of molecules constituting the carrier solution is set as an arbitrary value is expressed by the following equation (I) in the case where the value of Tc (min) (C=16) at the time when center value C of the carbon number of molecules constituting the carrier solution is 16 is set as a reference value.

$$Tc(\text{min})=Tc(\text{min})(C=16)+(\text{gradient shown in equation } (G) \text{ or equation } (H))\times(C-16) \quad \text{Equation (I)}$$

Figure 18:
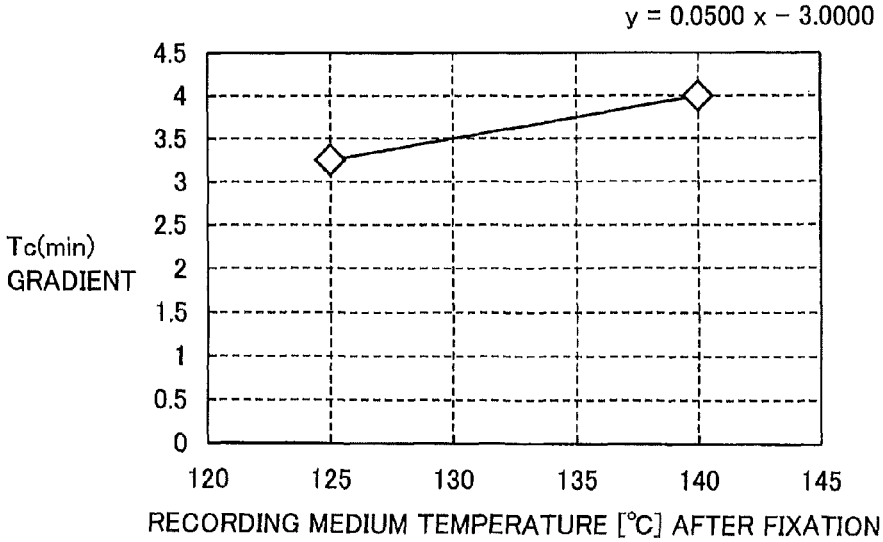
FIG. 18 is a diagram showing the relation between the gradient in the relational expression shown in FIG. 17 and the recording medium temperature after fixation.

FIG. 18 is a diagram showing the relation between the gradient in the relational expression shown in FIG. 17 and a recording medium temperature after fixation. It was found from the results shown in FIG. 17 that the relation between the gradient (Tc (min) gradient) (y) expressed in the above-mentioned approximate equation at an arbitrary temperature of the recording medium after fixation and recording medium temperature T2 (x) after fixation shows linear relationship as shown in FIG. 18, and this relation is approximated by the following equation (J):

$$y=0.05x-3 \quad \text{Equation (J).}$$

Therefore, by substituting (gradient shown in equation (G) or equation (H)) in the above-mentioned equation (I) with the equation (J), in consideration of recording medium temperature T2 after fixation and center value C of the carbon number of molecules constituting the carrier solution, it becomes possible to calculate lower limit value Tc (min) of the toner concentration before completion of fixation at which the difference in gloss level between the recording medium itself and the image can be suppressed to fall within a desired acceptable range.

Furthermore, when toner concentration Tc1 before completion of fixation satisfies the following equation (K) in consideration of the relation between fixation pressure P and toner concentration Tc1 before completion of fixation based on experiment 2, the difference between the gloss level of the recording medium itself and the gloss level of the image fixed on the recording medium can be suppressed to fall within a desired acceptable range, thereby allowing improvement in the image quality on the recording medium.

$$Tc1\geq-1.133\times T2+239.667+(-0.002\times T2+0.08)\times(P-400)+(0.05\times T2-3)\times(C-16) \quad \text{Equation (K)}$$

(Experiment 4)

Figure 19:
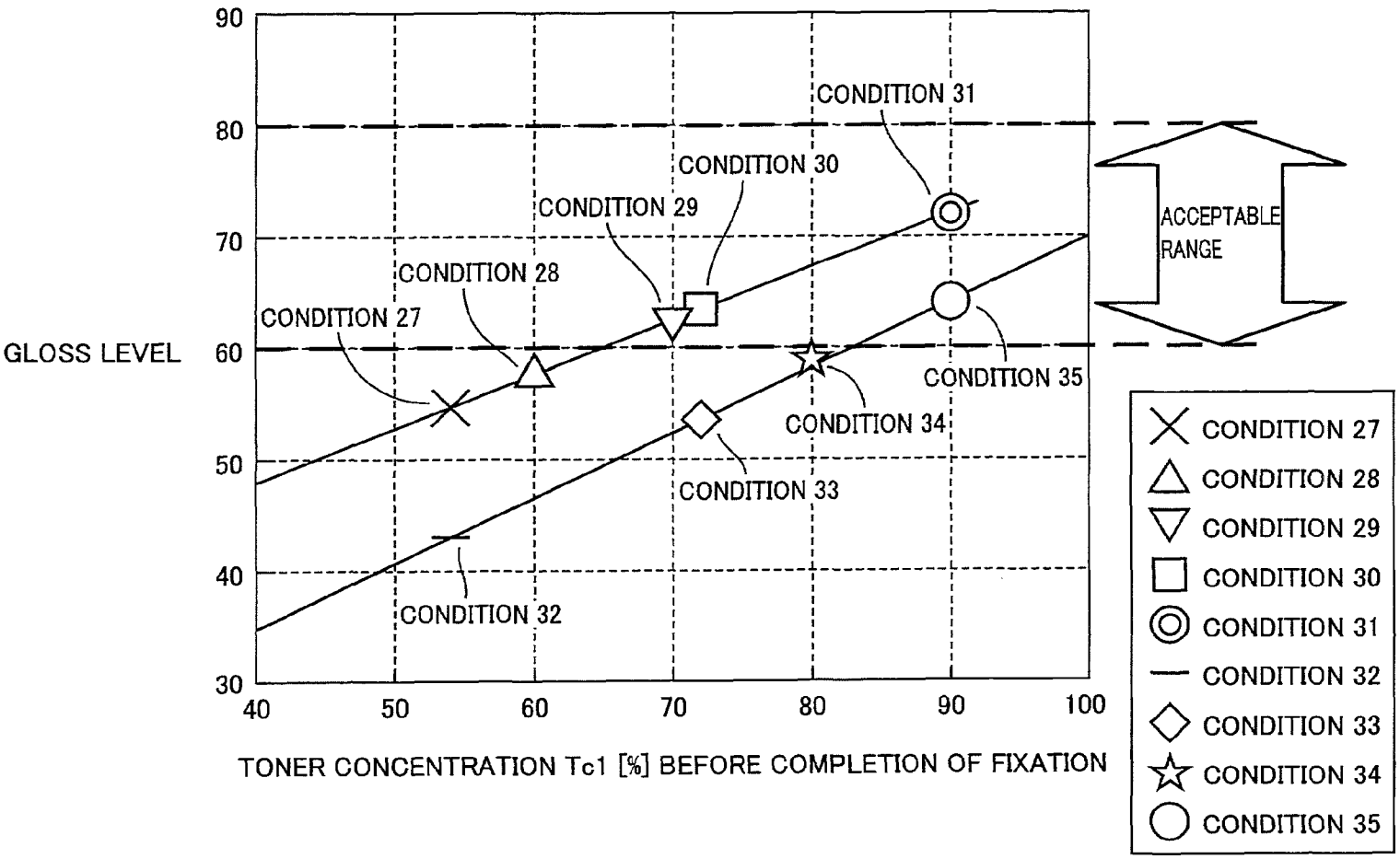
FIG. 19 is a diagram showing results of experiment 4.

Then, experiment 4 was conducted for deriving the relation between toner concentration Tc1 [weight %] of the toner image after noncontact heating (before completion of fixation) and a melting temperature Tm [° C.] of the toner. FIG. 19 is a diagram showing results of experiment 4, and FIG. 20 is a diagram showing conditions and results of experiment 4.

As shown in FIG. 20, as compared with experiment 1, the image fixation conditions in experiment 4 are different in toner concentration Tc1 before completion of fixation, and mainly different in toner type. Coated paper 90A was used as recording medium 90, toner B was used as toner, IP2028 was used as a carrier solution, and pressure P applied when pressurizing a toner image was set at 400 KPa. Furthermore, recording medium temperature after fixation was adjusted at 125° C. or 140° C. In this case, toner B is made of polyester resin and has an average particle diameter of 2 μm.

Furthermore, toner A and toner B are different in toner melting performance, and almost equal in toner melt viscosity. Melting temperature Tm [° C.] of the toner was measured with a flow tester (Shimadzu Corporation, CFT-500) by using the ½ method, in which case melting temperature Tm (A) of toner A was 143° C., and melting temperature Tm (B) of toner B was 137° C.

Under the above-described fixation conditions, image formation was carried out such that toner concentration Tc1 [weight %] before completion of fixation as shown in FIG. 20 reached a value shown in each of conditions 27 to 35, and then, the gloss level of the image after fixation under each of conditions 27 to 35 was measured.

Consequently, the gloss levels as shown in FIG. 20 were obtained under conditions 27 to 35. In particular, as shown in FIG. 19, the difference between the gloss level of the recording medium itself and the gloss level of the image fixed on the recording medium could be suppressed to fall within a desired acceptable range under each of conditions 29 to 31 and 35.

Furthermore, it turned out from the results of experiment 4 that the relation between toner concentration Tc1 [weight %] before completion of fixation and the gloss level of the image shows linear relationship as shown in FIG. 19 when recording medium temperature T2 after fixation is the same. Based on FIG. 19, when calculating lower limit Tc (min) (B) of toner concentration Tc1 [weight %] at which the difference between the gloss level of the recording medium itself and the gloss level of the image fixed on the recording medium could be suppressed to fall within a desired acceptable range (the value of the toner concentration in the case where the gloss level of the image was 60), this lower limit of the toner concentration was 83 weight % when recording medium temperature T2 after fixation was 125° C., and 66.5 weight % when recording medium temperature T2 after fixation was 140° C.

Figure 21:
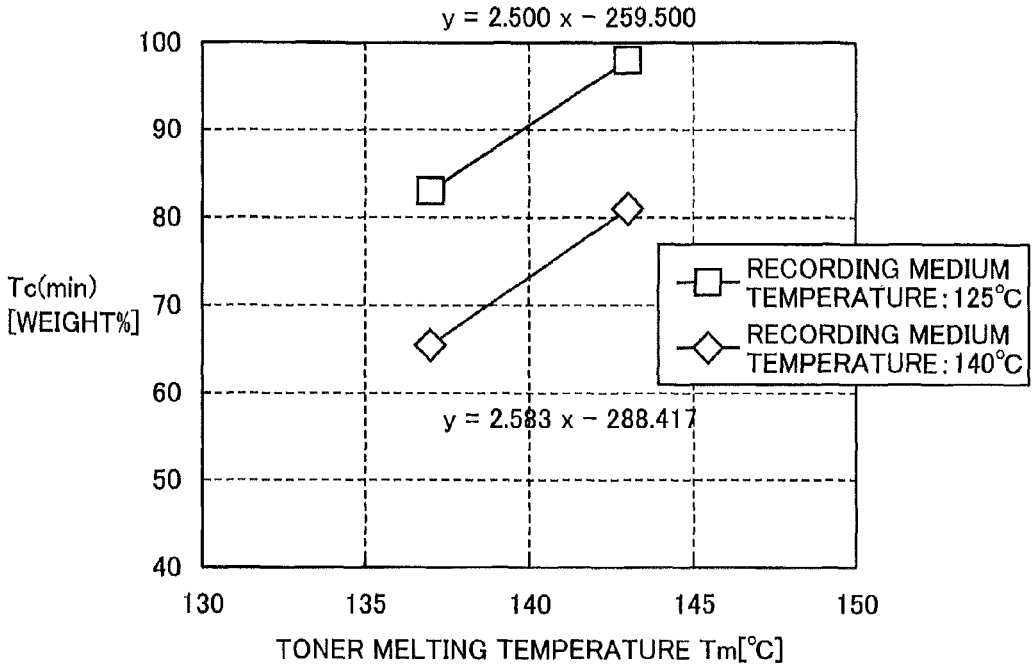
FIG. 21 is a graph showing a relational expression conceivable in consideration of the results of experiment 1 shown in FIG. 8 and the results of experiment 4 shown in FIG. 19.

FIG. 21 is a graph showing a relational expression conceivable in consideration of the results of experiment 1 shown in FIG. 8 and the results of experiment 4 shown in FIG. 19. It turned out from the results of experiments 1 and 4 that, in the case where recording medium temperature T2 after fixation reaches 125° C. or 140° C., the linear relationship between lower limit value Tc (min) of the toner concentration before completion of fixation at which the difference in gloss level between the recording medium itself and the image can be suppressed to fall within a desired acceptable range and melting temperature Tm [° C.] of the toner measured with a flow tester using the ½ method shows the relation as shown in FIG. 21.

As shown in FIG. 21, it was found that, in the case where recording medium temperature T2 after fixation reaches 125° C., the relation between lower limit value Tc (min) (T2=125) (y) [weight %] of the toner concentration before completion of fixation at which the difference in gloss level between the recording medium itself and the image can be suppressed to fall within a desired acceptable range and melting temperature Tm (x) [° C.] of the toner is expressed by the approximate equation of the following equation (L):

$$y=2.500x-259.500 \quad \text{Equation (L).}$$

Furthermore, it was found that, in the case where recording medium temperature T2 after fixation reaches 140° C., the relation between lower limit value Tc (min) (T2=140) (y) [weight %] of the toner concentration before completion of fixation at which the difference in gloss level between the recording medium itself and the image can be suppressed to fall within a desired acceptable range and melting temperature Tm (x) [° C.] of the toner is expressed by the approximate equation of the following equation (M):

$$y=2.583x-288.417 \quad \text{Equation (M).}$$

In other words, it was found that, in the case where recording medium temperature T2 after fixation is 125° C. or 140° C., the value of Tc (min) at the time when melting temperature Tm [° C.] of the toner is set as an arbitrary value is expressed by the following equation (N) in the case where the value of Tc (min) (Tm=143) at toner melting temperature Tm [° C.] of 143° C. is set as a reference value.

$$Tc(\min)=Tc(\min)(Tm=143)+(\text{gradient shown in equation } (L) \text{ or equation } (M))\times(Tm-143) \quad \text{Equation (N)}$$

Figure 22:
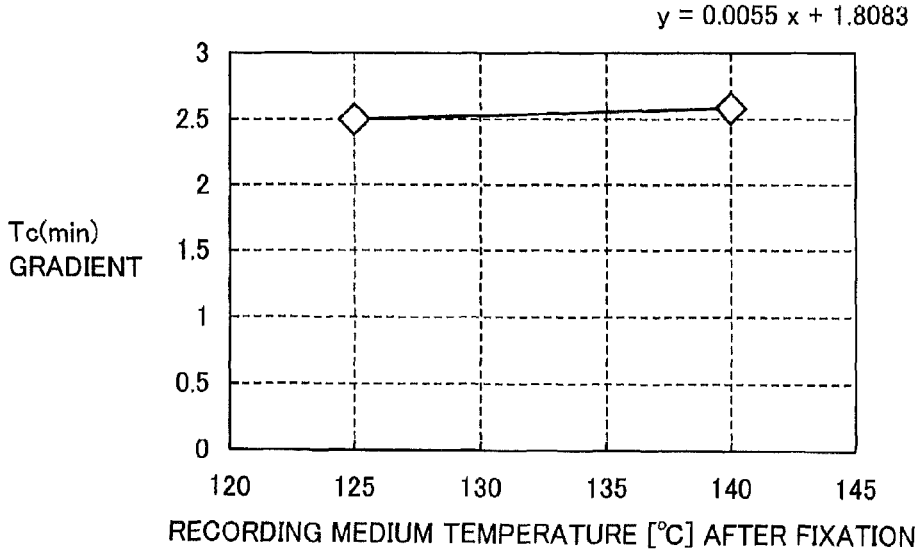
FIG. 22 is a diagram showing the relation between the gradient in the relational expression shown in FIG. 21 and a recording medium temperature after fixation.

FIG. 22 is a diagram showing the relation between the gradient in the relational expression shown in FIG. 21 and the recording medium temperature after fixation. It was found from the results shown in FIG. 21 that the relation between the gradient (Tc (min)) (y) expressed in the above-mentioned approximate equation at an arbitrary temperature of the recording medium after fixation and recording medium temperature T2 (x) after fixation shows linear relationship as shown in FIG. 22, and this relation is approximated by the following equation (O):

$$y=0.0055x+1.8083 \quad \text{Equation (O).}$$

Therefore, by substituting (gradient shown in equation (L) or equation (M)) in the above-mentioned equation (N) with the equation (O), in consideration of recording medium temperature T2 after fixation and melting temperature Tm [° C.] of the toner measured with a flow tester by using the ½ method, it becomes possible to calculate lower limit value Tc (min) of the toner concentration before completion of fixation at which the difference in gloss level between the recording medium itself and the image can be suppressed to fall within a desired acceptable range.

Furthermore, as a result of consideration of the results reviewing experiment 1, the relation between fixation pressure P and toner concentration Tc1 before completion of fixation based on experiment 2, and the relation between center value C of the carbon number of molecules constituting the carrier solution and toner concentration Tc1 before completion of fixation based on experiment 3, when toner concentration Tc1 before completion of fixation satisfies the following equation (P), the difference in gloss level between the recording medium itself and the image fixed on the recording medium can be suppressed to fall within a desired acceptable range, thereby allowing improvement in the image quality on the recording medium.

$$Tc1\geq-1.133\times T2+239.667+(-0.002\times T2+0.08)\times(P-400)+(0.05\times T2-3)\times(C-16)+(0.0055\times T2+1.8083)\times(Tm-143) \quad \text{Equation (P)}$$

(Experiment 5)

Figure 23:
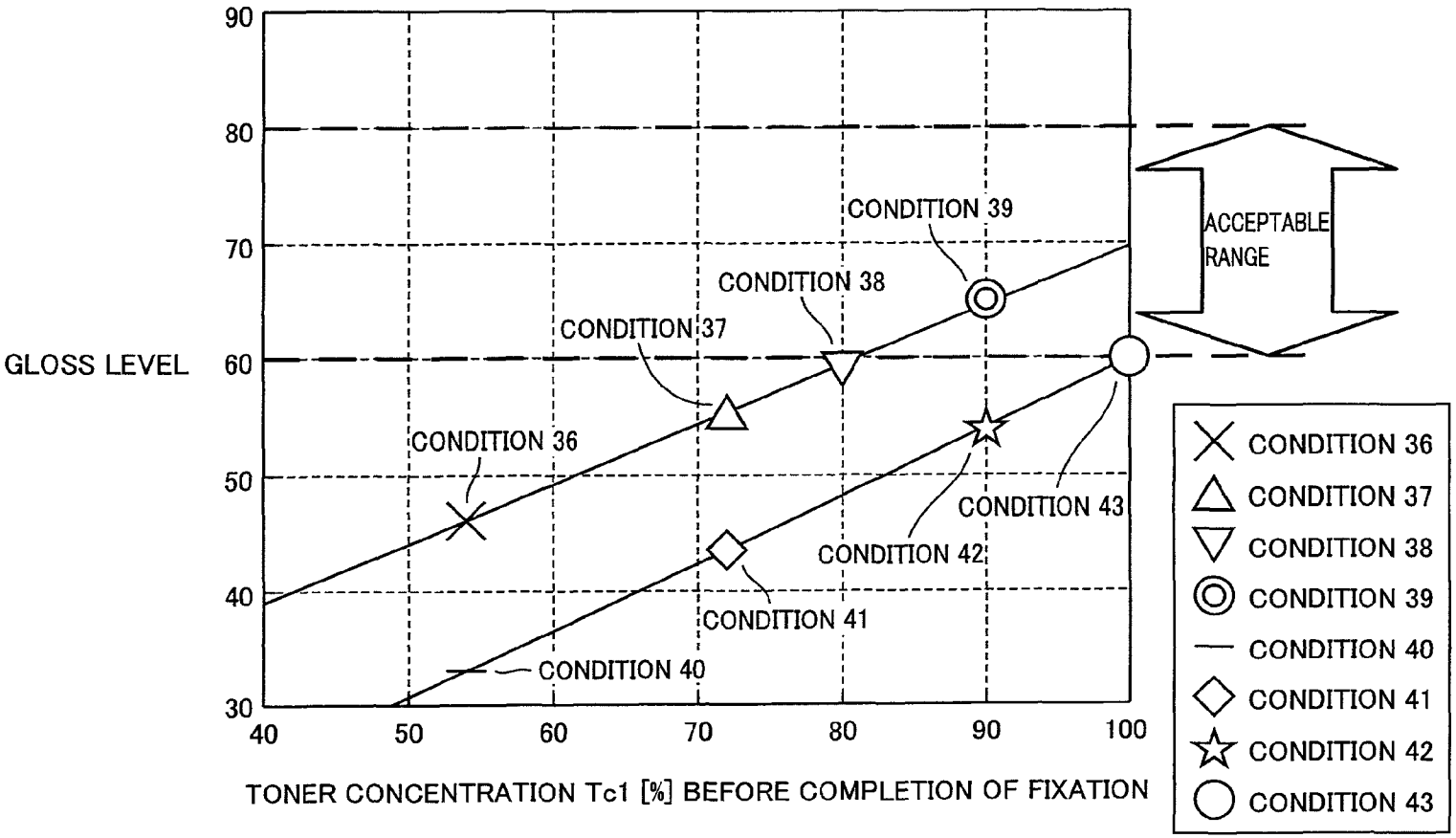
FIG. 23 is a diagram showing results of experiment 5.

Then, experiment 5 was conducted for deriving the relation between toner concentration Tc1 [weight %] of the toner image after noncontact heating (before completion of fixation) and a toner melting temperature η [Pa·S]. FIG. 23 is a diagram showing results of experiment 5. FIG. 24 is a diagram showing conditions and results of experiment 5.

As shown in FIG. 24, as compared with experiment 1, the image fixation conditions in experiment 5 are different in toner concentration Tc1 before completion of fixation, and mainly different in toner type. Coated paper 90A was used as recording medium 90, toner C was used as toner, IP2028 was used as a carrier solution, and pressure P applied when pressurizing a toner image was set at 500 KPa. Furthermore, recording medium temperature after fixation was adjusted at 125° C. or 140° C. In this case, toner C is made of polyester resin and has an average particle diameter of 2 μm.

Furthermore, toner A and toner C are different in toner melting performance and toner melt viscosity. Melting temperature Tm [° C.] of the toner and melt viscosity η [Pa·S] of the toner were measured with a flow tester (Shimadzu Corporation, CFT-500) by using the ½ method. In this case, toner A shows a melting temperature Tm (A) of 143° C. and melt viscosity η (A) of 200 Pa·S, and toner C shows melting temperature Tm (C) of 150° C. and melt viscosity η (B) of 300 Pa·S.

Under the above-described fixation conditions, image formation was carried out such that toner concentration Tc1 [weight %] before completion of fixation reached a value shown in each of conditions 36 to 43 as shown in FIG. 24, and the gloss level of the image after fixation under each of conditions 36 to 43 was measured using a prescribed measuring method defined as described above.

Consequently, the gloss levels as shown in FIG. 24 were achieved under conditions 36 to 43. In particular, as shown in FIG. 23, the difference between the gloss level of the recording medium itself and the gloss level of the image fixed on the recording medium could be suppressed to fall within a desired acceptable range under each of conditions 39 and 43.

Furthermore, it turned out from the results of experiment 5 that the relation between toner concentration Tc1 [weight %] before completion of fixation and the gloss level of the image shows linear relationship as shown in FIG. 23 when recording medium temperature T2 after fixation is the same.

Based on FIG. 23, when calculating lower limit Tc (min) of toner concentration Tc1 [weight %] at which the difference in gloss level between the recording medium itself and the image fixed on the recording medium could be suppressed to fall within a desired acceptable range (the value of the toner concentration in the case where the gloss level of the image was 60), this lower limit of the toner concentration was 100.0 weight % when recording medium temperature T2 after fixation was 125° C., and 80.8 weight % when recording medium temperature T2 after fixation was 140° C.

In this case, since toner C was different in melting temperature from toner A, the following equation (Oa) was employed in consideration of the relation with melting temperature Tm as described above, to correct a lower limit Tc (min) of toner concentration Tc1 at which the difference in gloss level between the recording medium itself and the image fixed on the recording medium could be suppressed to fall within a desired acceptable range (the value of the toner concentration in the case where the gloss level of the image was 60).

$$(0.0055\times T2+1.8083)\times(Tm-143) \quad \text{Equation (Oa)}$$

Consequently, as to the value of Tc (min) in the case where fixation pressure P was 500 KPa and toner melt viscosity η was 300 Pa·S, the corrected value of Tc (min) obtained by subtracting equation (Oa) was 82.5 weight % (=100.0−17.47) when recording medium temperature T2 after fixation was 125° C.; and 62.8 weight % (=80.8−18.05) when recording medium temperature T2 after fixation was 140° C.

Figure 25:
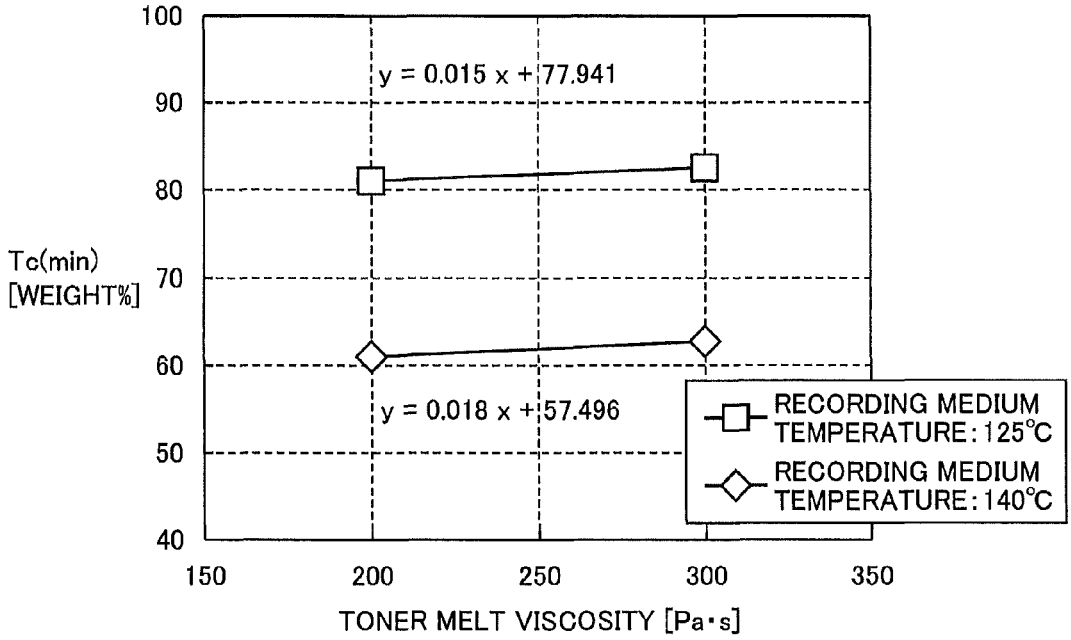
FIG. 25 is a graph showing a relational expression conceivable in consideration of the results of experiment 2 shown in FIG. 11 and the results after correction of experiment 5 shown in FIG. 23.

FIG. 25 is a graph showing a relational expression conceivable in consideration of the results of experiment 2 shown in FIG. 11 and the results after correction using the equation (Oa) of experiment 5 shown in FIG. 23. It turned out from the results of experiment 2 and the results after correction of experiment 5 that, in the case where recording medium temperature T2 after fixation reaches 125° C. or 140° C., the relation between lower limit value Tc (min) of the toner concentration before completion of fixation at which the difference in gloss level between the recording medium itself and the image can be suppressed to fall within a desired acceptable range and toner melt viscosity η [Pa·S] measured with a flow tester by using the ½ method shows linear relationship as shown in FIG. 25.

As shown in FIG. 25, it was found that, in the case where recording medium temperature T2 after fixation reaches 125° C., the relation between lower limit value Tc (min) (T2=125) (y) [weight %] of the toner concentration before completion of fixation at which the difference in gloss level between the recording medium itself and the image can be suppressed to fall within a desired acceptable range and melt viscosity η (x) [Pa·S] of the toner is expressed by the approximate equation of the following equation (Q):

$$y=0.015x+77.941 \qquad \text{Equation (Q).}$$

Furthermore, it was found that, in the case where recording medium temperature T2 after fixation reaches 140° C., the relation between lower limit value Tc (min) (T2=140) (y) [weight %] of the toner concentration before completion of fixation at which the difference in gloss level between the recording medium itself and the image can be suppressed to fall within a desired acceptable range and melt viscosity η (x) [Pa·S] of the toner is expressed by the approximate equation of the following equation (R):

$$y=0.018x+57.496 \qquad \text{Equation (R).}$$

In other words, it was found that, in the case where recording medium temperature T2 after fixation is 125° C. or 140° C., the value of Tc (min) at the time when melt viscosity η [Pa·S] of the toner is set as an arbitrary value is expressed by the following equation (S) in the case where the value of Tc (min) (η=200) at toner melt viscosity η [Pa·S] of 200 Pa·S is set as a reference value.

$$Tc(\text{min})=Tc(\text{min})(\eta=200)+(\text{gradient shown in equation } (Q) \text{ or equation } (R))\times(\eta-200) \qquad \text{Equation (S)}$$

Figure 26:
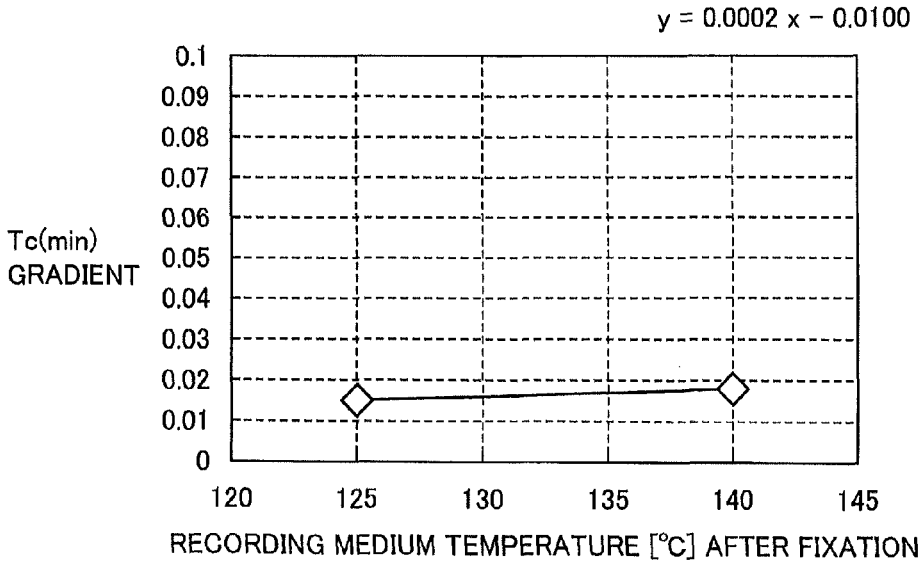
FIG. 26 is a diagram showing the relation between the gradient in the relational expression shown in FIG. 25 and a recording medium temperature after fixation.

FIG. 26 is a diagram showing the relation between the gradient in the relational expression shown in FIG. 25 and a recording medium temperature after fixation. It was found from the results shown in FIG. 25 that the relation between the gradient (Tc (min)) (y) expressed in the above-mentioned approximate equation at an arbitrary temperature of the recording medium after fixation and recording medium temperature T2 (x) after fixation shows linear relationship as shown in FIG. 26, and this relation is approximated by the following equation (T):

$$y=0.0002x-0.01 \qquad \text{Equation (T).}$$

Therefore, by substituting (gradient shown in equation (Q) or equation (R)) in the above-mentioned equation (S) with the equation (T), in consideration of recording medium temperature T2 after fixation and melt viscosity η [Pa·S] of the toner measured with a flow tester by using the ½ method, it becomes possible to calculate lower limit value Tc (min) of the toner concentration before completion of fixation at which the difference in gloss level between the recording medium itself and the image can be suppressed to fall within a desired acceptable range.

Furthermore, as a result of consideration of the results reviewing experiment 1, the relation between fixation pressure P and toner concentration Tc1 before completion of fixation based on experiment 2, the relation between center value C of the carbon number of molecules constituting the carrier solution and toner concentration Tc1 before completion of fixation based on experiment 3, and the relation between toner melting temperature Tm and toner concentration Tc1 based on experiment 4, when toner concentration Tc1 before completion of fixation satisfies the following equation (4), the difference between the gloss level of the recording medium itself and the gloss level of the image fixed on the recording medium can be suppressed to fall within a desired acceptable range, thereby allowing improvement in the image quality on the recording medium.

$$Tc1\geq-1.133\times T2+239.667+(-0.002\times T2+0.08)\times(P-400)+(0.05\times T2-3)\times(C-16)+(0.0055\times T2+1.8083)\times(Tm-143)+(0.0002\times T2-0.01)\times(\eta-200) \qquad \text{Equation (4)}$$

Therefore, according to image forming apparatus 1 in the present embodiment, in the case where the gloss level of the recording medium is high, by providing the above-described configuration and also by fixing a toner image on a recording medium using noncontact heating device 60 and pressurizing and heating mechanism 50 while satisfying the above-mentioned equation (4) in addition to the above-mentioned equations (1) to (3), the difference between the gloss level of the recording medium itself and the gloss level of the image fixed on the recording medium can be more reliably suppressed to fall within a desired acceptable range, thereby allowing further improvement in the image quality on the recording medium.

Furthermore, according to the image forming method used in image forming apparatus 1 in the present embodiment, by providing the above-described configuration and also by controlling noncontact heating device 60 and pressurizing and heating mechanism 50 while satisfying the above-mentioned equation (4) in addition to the above-mentioned equations (1) to (3), the difference between the gloss level of the recording medium itself and the gloss level of the image fixed on the recording medium can be more reliably suppressed to fall within a desired acceptable range, thereby allowing further improvement in the image quality on the recording medium.

Recording medium temperature T2 after fixation in the embodiment of the present invention is determined based on the fixation nip time during which recording medium 90 passes through the pressed-contact nip portion formed between fixing roller 51 and pressurizing roller 52, the temperatures of fixing roller 51 and pressurizing roller 52 during fixation, the type (thickness) of the recording medium, the environmental temperature, and the like. Accordingly, a prescribed recording medium temperature T2 can be achieved after fixation by controlling these parameters obtained in advance by experiments and the like.

Furthermore, toner concentration Tc1 before completion of fixation in the embodiment of the present invention is determined based on the set temperature of noncontact heating heater 61 in noncontact heating device 60, the heating time of noncontact heating heater 61, the distance between noncontact heating heater 61 and the recording medium, the type (thickness) of the recording medium, the environmental temperature, and the like. Accordingly, a prescribed toner concentration Tc1 before completion of fixation can be obtained by controlling these parameters obtained in advance by experiments and the like.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus forming an image on a recording medium while conveying said recording medium, said image forming apparatus comprising:

a developing mechanism developing a toner image on an image carrier by a developer containing toner particles and a carrier solution;

a transfer mechanism transferring the toner image developed on said image carrier onto said recording medium;

a fixing unit having a noncontact heating device heating said toner image without contacting said toner image transferred onto said recording medium, and a pressurizing and heating mechanism disposed downstream of said noncontact heating device in a direction in which said recording medium is conveyed and capable of pressurizing and heating said toner image by causing said recording medium to pass through a nip portion formed by a heating member and a pressurizing member pressed in contact with each other;

an obtaining unit obtaining gloss level information of the recording medium to be conveyed; and a control unit controlling an operation of each of said noncontact heating device and said pressurizing and heating mechanism, said control unit controlling the operation of each of said noncontact heating device and said pressurizing and heating mechanism such that, when the gloss level information of said recording medium obtained in said obtaining unit shows high gloss, said recording medium is heated by said noncontact heating device and caused to pass through said nip portion so as to be pressurized and heated by said pressurizing and heating mechanism, and such that, when the gloss level information of said recording medium shows low gloss, said recording medium is heated by said noncontact heating device and caused to pass through said fixing unit without being pressurized and heated by said pressurizing and heating mechanism, and assuming that a temperature of said recording medium after being heated by said noncontact heating device is defined as T1 [° C.], a temperature of said recording medium after being pressurized and heated by said pressurizing and heating mechanism is defined as T2 [° C.], and a toner concentration of said toner image after being heated by said noncontact heating device is defined as Tc1 [weight %] when the gloss level information of said recording medium shows high gloss, and assuming that a temperature of said recording medium after being heated by said noncontact heating device is defined as T3 [° C.] and a toner concentration of said toner image after being heated by said noncontact heating device is defined as Tc2 [weight %] when the gloss level information of said recording medium shows low gloss, the following equations (1), (2) and (3) being satisfied:

$$T1<T2 \quad \text{Equation (1);}$$

$$T1<T3 \quad \text{Equation (2);}$$

$$Tc1<Tc2 \quad \text{Equation (3).}$$

2. The image forming apparatus according to claim 1, wherein assuming that pressure applied when said toner image is pressurized by said pressurizing and heating mechanism is defined as P [KPa], a center value of a carbon number of molecules constituting said carrier solution is defined as C, a melting temperature of toner measured with a flow tester by using a ½ method is defined as Tm [° C.], and viscosity of said toner at said melting temperature is defined as η [Pa·s] when the gloss level information of said recording medium shows high gloss, the following equation (4) is satisfied:

$$Tc1 \geq -1.133\times T2+239.667+(-0.002\times T2+0.08)\times(P-400)+(0.05\times T2-3)\times(C-16)+(0.0055\times T2+1.8083)\times(Tm-143)+(0.0002\times T2-0.01)\times(\eta-200) \quad \text{Equation (4).}$$

3. The image forming apparatus according to claim 1, wherein said pressurizing and heating mechanism has a pressing-contact/separation mechanism capable of switching between a pressed-contact state where said nip portion is formed by moving at least one of said heating member and said pressurizing member and a separated state where said heating member and said pressurizing member are not in contact with each other, and said control unit controls the operation of each of said noncontact heating device and said pressurizing and heating mechanism such that, when the gloss level information of said recording medium shows low gloss, said pressurizing and heating mechanism is set in said separated state by said pressing-contact/separation mechanism, and said recording medium is heated by said noncontact heating device and caused to pass through said pressurizing and heating mechanism in said separated state.

4. An image forming method of forming an image on a recording medium in an image forming apparatus forming an image on a recording medium while conveying said recording medium, said image forming apparatus including a developing mechanism developing a toner image on an image carrier by a developer containing toner particles and a carrier solution, a transfer mechanism transferring the toner image developed on said image carrier onto said recording medium, and a fixing unit having a noncontact heating device heating said toner image without contacting said toner image transferred onto said recording medium, and a pressurizing and heating mechanism disposed downstream of said noncontact heating device in a direction in which said recording medium is conveyed and capable of pressurizing and heating said toner image by causing said recording medium to pass through a nip portion formed by a heating member and a pressurizing member pressed in contact with each other, said image forming method performing the steps of:

obtaining gloss level information of said recording medium;

developing the toner image on said image carrier by said developing mechanism;

transferring the toner image developed on said image carrier onto said recording medium; and controlling an operation of each of said noncontact heating device and said pressurizing and heating mechanism such that, when the gloss level information obtained in said step of obtaining the gloss level information shows high gloss, said recording medium is heated by said noncontact heating device and caused to pass through said nip portion so as to be pressurized and heated by said pressurizing and heating mechanism, and such that, when said gloss level information obtained shows low gloss, said recording medium is heated by said noncontact heating device and caused to pass through said fixing unit without being pressurized and heated by said pressurizing and heating mechanism, and assuming that a temperature of said recording medium after being heated by said noncontact heating device is defined as T1 [° C.], a temperature of said recording medium after being pressurized and heated by said pressurizing and heating mechanism is defined as T2 [° C.], and a toner concentration of said toner image after being heated by said noncontact heating device is defined as Tc1 [weight %] when the gloss level information of said recording medium shows high gloss, and assuming that a temperature of said recording medium after being heated by said noncontact heating device is defined as T3 [° C.] and a toner concentration of said toner image after being heated by said noncontact heating device is defined as Tc2 [weight %] when the gloss level information of said recording medium shows low gloss, the following equations (1), (2) and (3) being satisfied:

$$T1<T2 \quad \text{Equation (1)},$$

$$T1<T3 \quad \text{Equation (2)};$$

$$Tc1<Tc2 \quad \text{Equation (3)}.$$

5. The image forming method of forming an image on a recording medium according to claim 4, wherein assuming that pressure applied when said toner image is pressurized by said pressurizing and heating mechanism is defined as P [KPa], a center value of a carbon number of molecules constituting said carrier solution is defined as C, a melting temperature of toner measured with a flow tester by using a ½ method is defined as Tm [° C.], and viscosity of said toner at said melting temperature is defined as η [Pa·s] when the gloss level information of said recording medium shows high gloss, the following equation (4) is satisfied:

$$Tc1 \geq -1.133\times T2+239.667+(-0.002\times T2+0.08)\times(P-400)+(0.05\times T2-3)\times(C-16)+(0.0055\times T2+1.8083)\times(Tm-143)+(0.0002\times T2-0.01)\times(\eta-200) \quad \text{Equation (4)}.$$

* * * * *